US008001892B2

(12) United States Patent
Eckert et al.

(10) Patent No.: US 8,001,892 B2
(45) Date of Patent: Aug. 23, 2011

(54) PRINTING MACHINE SYSTEM

(75) Inventors: Günther Oskar Eckert, Zellingen (DE); Burkard Otto Herbert, Würzburg (DE)

(73) Assignee: Koenig & Bauer Aktiengesllschaft, Wurzburg (DE)

( * ) Notice: Subject to any disclaimer, the term of this patent is extended or adjusted under 35 U.S.C. 154(b) by 577 days.

(21) Appl. No.: 12/086,342

(22) PCT Filed: Aug. 17, 2006

(86) PCT No.: PCT/EP2006/065426

§ 371 (c)(1),
(2), (4) Date: Jun. 11, 2008

(87) PCT Pub. No.: WO2007/071460

PCT Pub. Date: Jun. 28, 2007

(65) Prior Publication Data

US 2009/0064880 A1 Mar. 12, 2009

Related U.S. Application Data

(60) Provisional application No. 60/750,357, filed on Dec. 15, 2005.

(30) Foreign Application Priority Data

May 3, 2006 (DE) ..... 10 2006 020 322

(51) Int. Cl.
*B41F 13/54* (2006.01)

(52) U.S. Cl. ..... 101/228; 101/221; 270/20.1

(58) Field of Classification Search ..... 101/180, 101/181, 220, 221, 227, 228, 479, 480; 270/5.01, 270/10, 20.1, 41, 42

See application file for complete search history.

(56) References Cited

U.S. PATENT DOCUMENTS 1,240,011 A * 9/1917 Bechman ..... 270/5.01
1,240,014 A * 9/1917 Bechman ..... 270/8
1,972,506 A 9/1934 Wood
2,920,887 A 1/1960 Keightley (Continued)

FOREIGN PATENT DOCUMENTS

DE 40 12 396 A1 10/1991

(Continued)

OTHER PUBLICATIONS

Braun, Alexander, "Atlas des Zeitungs- und Jllustrationsdruckes," Polygraph Verlag GMBH (Frankfurt AM Main).

(Continued)

*Primary Examiner* — Ren Yan

(74) *Attorney, Agent, or Firm* — Jones, Tullar & Cooper, P.C.

(57) ABSTRACT

A printing machine system includes a first printing machine which has at least one first printing unit and a first fold forming funnel and that is arranged in the machine alignment of the at least first printing unit. A second printing machine, which has at least one second printing unit, and a second fold forming funnel, is also provided in the printing machine system. The second fold forming funnel is in machine alignment with the at least one second printing unit. The printing group cylinders of the first and second printing units are positioned substantially orthogonally in relationship to each other in their axial directions. The two fold forming funnel structures are positioned substantially orthogonally in respect to each other in a line running in a direction of material web transport as projected onto a horizontal plane.

50 Claims, 26 Drawing Sheets

U.S. PATENT DOCUMENTS

| | | | | |
|---|---|---|---|---|
| 5,117,753 | A | 6/1992 | Mamberer | |
| 5,676,056 | A | 10/1997 | Stein et al. | |
| 6,892,635 | B2 | 5/2005 | Herbert | |
| 6,899,026 | B2 | 5/2005 | Weis | |
| 7,159,514 | B2 | 1/2007 | Eckert et al. | |
| 7,845,276 | B2 * | 12/2010 | Eckert et al. | 101/424.1 |
| 2006/0187472 | A1 | 8/2006 | Elschner et al. | |

FOREIGN PATENT DOCUMENTS

| | | | |
|---|---|---|---|
| DE | 102 38 010 | A1 | 3/2004 |
| DE | 20 2005 010 058 | | 11/2005 |
| EP | 0 741 020 | A2 | 11/1996 |
| EP | 1 683 634 | A1 | 7/2006 |
| WO | WO 03/031182 | A1 | 4/2003 |
| WO | WO 2004/024448 | A1 | 3/2004 |

OTHER PUBLICATIONS

Kipphan, Helmut (HRSG.), "Handbuch der Printmedien, Technologien und Produktionsverfahren," Springer.

* cited by examiner a)

b)

c)

PRINTING MACHINE SYSTEM

CROSS-REFERENCE TO RELATED APPLICATIONS

This application is the U.S. national phase, under 35 USC 371, of PCT/EP2006/065426, filed Aug. 17, 2006; published as WO 2007/071460 A1 on Jun. 28, 2007 and claiming priority to U.S. 60/750,357, filed Dec. 15, 2005 and to DE 10 2006 020 322.4, filed May 3, 2006, the disclosures of which are expressly incorporated herein by reference.

FIELD OF THE INVENTION

The present invention is directed a printing press system. The printing press system includes first and second printing presses, each with at least one printing unit. The printing unit cylinders in the two printing presses are arranged orthogonally to each other.

BACKGROUND OF THE INVENTION

A printing press, that has both printing units for newspaper printing and a printing unit for printing semi-commercial products, is known from DE 102 38 010 A1. Production is performed on a shared folding unit, which shared folding unit has both a newspaper folder and an illustration folder.

WO 2004/024448 A1 describes a printing press having a plurality of printing units, at least one dryer and a folding unit. Printing units are arranged side by side, in respect to the axial direction of their cylinders. A web path from the printing units to a former assembly, which former assembly has three fold formers side by side, has a 90° bend that projects into the horizontal plane.

In WO 03/031182 A1, a printing press, with a plurality of printing towers, for use printing newspaper products is described. The printing towers are arranged in a machine alignment that is perpendicular to the axial direction of their printing group cylinders. The printing press is thus configured as a so-called linear machine. The lead-in direction of fold formers of a former assembly, which is assigned in the straight-line passage, also extend along or at least parallel to the machine alignment.

Two printing machine lines, each with a plurality of printing groups, which plurality of printing groups are arranged side by side, and through which a web passes in sequence, are known from DE 40 12 396 A1. Auxiliary devices of the one printing press can be used by transferring the web to the other printing press.

A printing press having a plurality of printing groups, which are arranged side by side, and also having an aligned former assembly is described in U.S. Pat. No. 1,972,506. From printing groups that are arranged offset by 90° from the first machine alignment, partial webs, that have been printed in a multicolor process, are fed to the former assembly of the first machine.

DE 20 2005 010 058 U1 and EP 16 83 634 A1 both show a printing press with two printing press subsystems. The printing press subsystems are configured differently such that webs of printing substrate can be printed in them, thereby producing a varying number of printed pages.

In the publication "Handbook of Print Media"; Helmut Kipphan; Springer, 2000; pp 357 and 358, examples of printing presses or of printing press systems, with combined heatset/coldset machine lines, are provided.

The publication "Atlas of Newspaper and Illustration Printing"; Alexander Braun; Polygraph, 1960, shows, on page 152, a printing press with a printing group that is four plates wide and with a double-width former assembly with a folding unit arranged downstream from it. From a cover or from a supplement machine, webs, that are one page wide and which have been printed with printing groups that are offset 90° from the first machine, can be fed in the folding unit of the first-mentioned machine.

SUMMARY OF THE INVENTION

The object of the present invention is to provide a printing press system.

The object is attained according to the invention by the provision of the printing press system with a first printing press that has at least one first printing unit and one first former assembly, which is arranged in a machine alignment of this first printing unit. A second printing press has at least one second printing unit and with one second former assembly that is arranged in the machine alignment of the second printing unit. The printing group cylinders of the first and second printing units are arranged orthogonally to each other, in their respective axial directions. The two former assemblies are also orthogonal to each other, with regard to their web transport directions, as projected onto a horizontal plane of a web entering each such former assembly. Printed webs from either printing press can be directed either to their own former assembly or can be turned by 90° and directed to the former assembly associated with the other printing press.

The benefits to be achieved, in accordance with the present invention, consist especially in that the arrangement of two different printing presses in a printing press system, in accordance with the present invention, allows both different products and hybrid products to be produced in a simple and variable manner. By combining, for example, types of printing presses, or by combining printing units that are different from one another, the widest range of requirements, in terms of product diversity and quality, can be accommodated.

For example, a printing press, such as, for example, a newspaper printing press, can be configured for pure newspaper production, which is performed over a relatively short period of time during the night. In addition, the same printing press can also be used during the day for other products, such as, for example, for hybrid products.

The angled and/or orthogonal arrangement of the printing press system, in accordance with the present invention, enables increased variability in combining webs from the one type of printing units, such as, for example, from semi-commercial printing units, into the flow of webs from the other printing units, such as, for example, newspaper printing units. With this increased variability, the webs are less in the way than they would be with a purely linear arrangement. This increases the variability of the positioning of these "commercial webs" in the overall product. Heatset and coldset webs and/or webs from printing units of different widths and/or of different circumferences and/or from different printing processes can be combined with considerably greater flexibility. The heatset webs or the partial webs, which are being fed in from the side, can be rolled in or added at nearly any point in the product.

With the orthogonal arrangement of printing presses, in accordance with the present invention, e.g., newspaper and (semi) commercial products can also be produced simultaneously, and independently of one another, without restrictions. This is because the webs from the two machines do not run within the same alignment, as is the case with a purely linear machine, and thus do not block one another. The machines, configured, such as, for example, as heatset and coldset machines, can be operated practically "without secondary actions", and optionally can be operated as completely stand-alone machines.

BRIEF DESCRIPTION OF THE DRAWINGS

Preferred embodiments of the present invention are represented in the accompanying set of drawings and will be specified in greater detail in what follows.

The drawings show.

DESCRIPTION OF PREFERRED EMBODIMENTS

Figure 1:
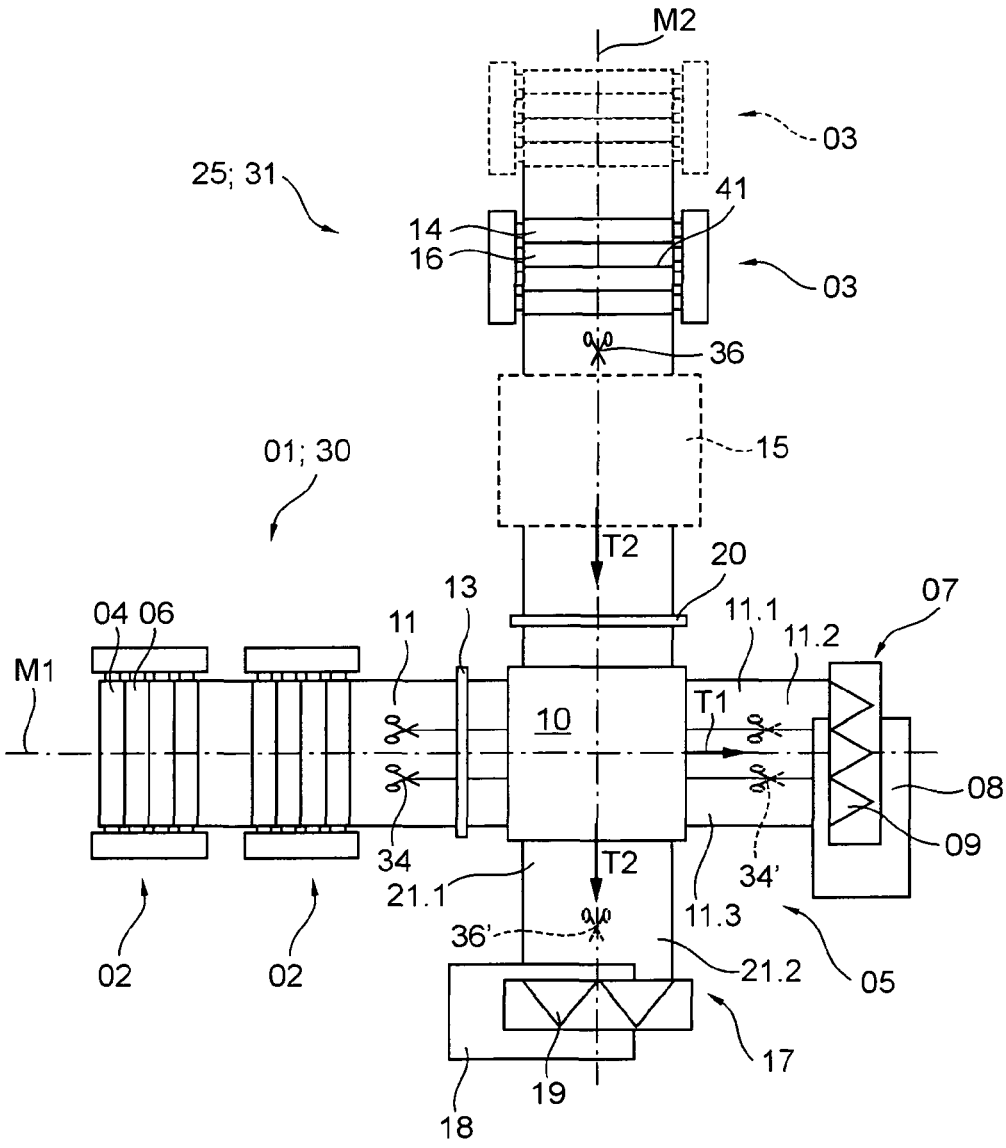
FIG. 1 a schematic top plan view of a printing press system in accordance with the present invention.

Referring initially to FIG. 1, there is shown a schematic plan view of a printing press system in accordance with the present invention. In this printing press system, in addition to one or more printing units 02 of a first type, or first printing units 02 in a first printing press 01, one or more printing units 03 of a second type or second printing units 03 in a second printing press 31 are provided. The first and second printing units 02; 03 are oriented laterally, and especially are angled, in relation to one another, in a manner that will be described in greater detail in the discussion which follows.

In a first embodiment of the present invention, the two types of printing units 02; 03 can be the same. When this is the case, they can both operate using the same one of the printing processes listed below, with or without drying devices 15, as discussed subsequently, and with the same dimensions, length/circumference, for the imaging printing group cylinders 04; 14 as is also discussed subsequently.

Particular advantages, with respect to product design, are achieved when the two types of printing units 02; 03 are different from one another, based upon the specific requirements of the product.

The two types of printing units 02; 03 or the two types of printing presses 01; 31 can differ from one another, for example, in terms of the printing process. For example, the printing unit 02 of the first type can be configured as an offset printing unit, a direct printing unit, a flexo printing unit, or as a printing unit that employs a non-impact process, such as a printing process without a printing forme, or inking without the mechanical action of printing cylinders on the printing substrate, such as, for example, printing on photosensitive paper, ink-jet printing or laser printing, and the first printing press 01 can be operated under the corresponding process. The printing unit 03 of the second, other type can then be configured according to another of the listed processes. For example, the first printing press 01 can be configured especially as a newspaper printing press 01 with offset printing units, while the second printing press 31 has one or more direct printing or flexo printing units or non-impact printing units. One printing press 01 may also be configured as a newspaper printing press 01 with offset printing units, while the other printing press 31 has offset printing units for commercial printing and thus has printing groups having an essentially horizontal web path for high-quality commercial printing, with a dryer downstream or is configured as a commercial printing press.

The two types of printing units 02; 03 or of printing presses 01; 31 can differ from one another, in addition to, or in place of a difference in the aforementioned printing process. One of the printing presses 01; 31 may be operated with a drying of the freshly printed web, using, for example, the heatset process, which heatset process is discussed below, while the other may be operated without drying, such as, for example, using the "coldset process". The printing press 31; 01 that operates using the heatset process then has a suitable drying device 15, such as a dryer 15, and the associated printing units 03; 02 are configured with correspondingly modified units and/or with supplementary equipment, as will also be discussed below. Especially advantageously, one printing press 01 can also be configured as a newspaper printing press 01 with printing units, such as offset printing units, that are configured solely for newspaper and/or coldset printing, referred to as coldset printing units 02, while the other printing press 31 has one or more offset printing unit(s) configured for semi-commercial and/or "heatset printing", referred to as heatset printing unit(s), and drying devices 15. The prefix "heatset" refers not only to drying the web using a thermal process, but, in contrast to the "coldset" process, also includes drying the web using other drying devices, such as, for example, UV or IR dryers.

The two types of printing units 02; 03 or of printing presses 01; 31 can differ, in addition to, or in place of a difference in the aforementioned printing process and/or with respect to a drying process, in that the two types of printing units 02; 03 can differ in the maximum length that is actively used for printing and/or in the circumference of the imaging printing group cylinder 04; 14, such as, for example, the forme cylinder 04; 14, as will be discussed below. In other words, they can be configured to have a length and/or a circumference which corresponds to a different number of printed pages of the same format, such as, for example, newspaper pages in broadsheet format. For example, the printing unit 02 or 03 of the one type can be configured having printing group cylinders 04; 14 that are the width of four printed pages, and especially of four newspaper pages of "double width" and, at least for the forme cylinder 04, with a circumference that corresponds to the length of two printed pages "double circumference", and especially of two newspaper pages, "double circumference", in a so-called "4/2" configuration. The printing unit 03; 02 of the other type can be structured in a 4 length/1 circumference of at least the forme cylinder 14; 04 configuration, in a 2/2 configuration, "single width" and "double circumference", or in a 6/2 configuration, "triple width" and "double circumference". With the single-circumference configuration, a printing group cylinder 06; 16, such as, for example, a transfer cylinder 06; 16, as will be discussed below, that cooperates with the "single-circumference" forme cylinder 04; 14 can also be configured as "double circumference". In principle, the one of the two printing presses 01; 31 can be structured as one of the configurations 2/1, "single width" and "single circumference", 2/2, "single width" and "double circumference", 4/1, "double width" and "single circumference", 4/2, "double width" and "double circumference", 6/1, "triple width" and "single circumference", 6/2, "triple width" and "double circumference", whereas the other of the two printing presses 31; 01 has one of the aforementioned configurations that is different from that of the first. A wider, for example, double width, printing unit 02 can also be single circumference, a 4/1 configuration, and the printing unit 03 of the second type can be configured as single width and double circumference, 2/2 configuration. In general terms, in an x/y configuration, the forme cylinder 04; 14 of the respective printing unit 02; 03 supports a number "x" of print images side by side lengthwise along its circumference, and a number "y" of print images, or the number of printing formes, such as, printing plates, each with one print image, in a circumferential direction, in the respective format, such as, for example, in tabloid format or in newspaper format, and especially in broadsheet format, in the case of newspaper format.

In the selection of the configuration of the respective printing press 01; 31 with respect to the differentiation in circumference, either single circumference or double circumference configuration, a single circumference configuration, such as, for example, 2/1, 4/1 or 6/1, can provide advantages in terms of the printing formes that must be changed with a shift in production, and/or in terms of the page jump in the product to be produced and/or in terms of a machine height. A double circumference configuration, such as, for example, 2/2, 4/2, 62, however, can offer advantages with respect to a maximum producible product thickness in collect-run production. With respect to differentiation in the printed pages that are arranged side by side lengthwise, the product thickness and/or the efficiency to be achieved is also a decisive criterion. For example, if only a small number of special sections are required in the hybrid product, and if, in stand-alone production using this, for example, second printing press 03, only products of small circumference are required, then, for example, a single-width configuration may be sufficient. Thus, with configurations of the two types of printing units 02; 03, that are different in terms of width and/or circumference, an adjustment to the requirements of a specific product spectrum can be specifically made.

With a triple-width configuration, 6/1 or 6/2, one of the printing units 02; 03 or printing presses 01; 31 can have, on its transfer cylinder 06; 16, which is six print pages wide, one printing blanket that is continuous over its entire length, two printing blankets, each three pages wide, or three printing blankets, each two pages wide, which configurations are not specifically shown, and especially can have metal printing blankets with a dimensionally stable support plate, such as, for example, a metal plate, and can also have a flexible and/or compressible coating. The configuration comprising two rubber blankets, each three pages wide, and arranged side by side lengthwise offers advantages in terms of increased variability, such as for pop-up production or variable web width. The rubber blankets can be offset over their entire circumference and, if there are a plurality of such blankets lengthwise, can also be offset circumferentially in relation to one another.

A plurality of printing units 02 of the first type, such as, for example, of "dedicated" coldset printing units 02, and/or at least one printing unit 02 of the first type, such as, for example, a coldset printing unit 02, and a former assembly 07 are arranged in the manner of a so-called linear machine 01, in a shared machine alignment M1, as seen in FIG. 1, which shared machine alignment M1 is perpendicular to the axial direction of its printing group cylinders 04; 06. If a plurality of printing units 02 of the first type are present in linear arrangement, the former assembly 07 that is assigned to at least one of the printing units 02 can also be arranged in this machine alignment M1, or "straight-line configuration". In the case of offset printing, the printing group cylinders 04; 06 of the first printed unit 02 are structured, for example, as forme cylinders 04, typically as imaging printing group cylinders 04, and transfer cylinders 06. A folder 08, such as, for example, a coldset folder 08 in the case of a printing press 01 that is configured as a newspaper printing press 01, is situated downstream from the former assembly 07. The former assembly 07 has one or more fold formers 09, which are preferably oriented such that webs of material 11, such as, for example, paper webs 11, or webs 11, which are running up to the fold formers 09, have a direction of transport T1, which is projected into the horizontal plane and which direction of transport T1 extends along or parallel to the machine alignment M1 of the first printing press 01. In other words, the webs 11 printed in the printing units 02 of the first type can be fed to the fold formers 09 in so-called straight-line travel. The entire first printing press 01, which is configured as a linear machine 01, or a section of it having at least one printing unit 02 and an assigned former assembly 07, can also be characterized as a first machine line 30.

The first printing press 01 preferably has a plurality of groups of printing units 02 arranged adjacent to one another, and between which, one or two former assemblies 07 is or are arranged. In this manner of optionally overlapping groups, the mass product, such as, for example, a newspaper can be produced on the first printing press 01, while on the other, second printing press 31 either individual product sections for a resultant hybrid product, or a separate product, such as, for example, one of higher quality and/or of smaller dimensions and/or a smaller number of copies can be produced.

The printing press system in accordance with the present invention can, in principle, involve any above-mentioned combination of two different printing units 02; 03 or of two different printing presses 01; 31. The printing units 02 of the first printing press 01, however, are preferably configured as printing towers 02, each such printing tower 2 preferably having two stacked H-printing units or two stacked satellite printing units. In principle, the printing towers 02 can also have four blanket-to-blanket printing groups for accomplishment of double-sided printing. The web 11 then runs essentially vertically between the printing points in the printing units 02 of the first printing press 01.

Figure 2:
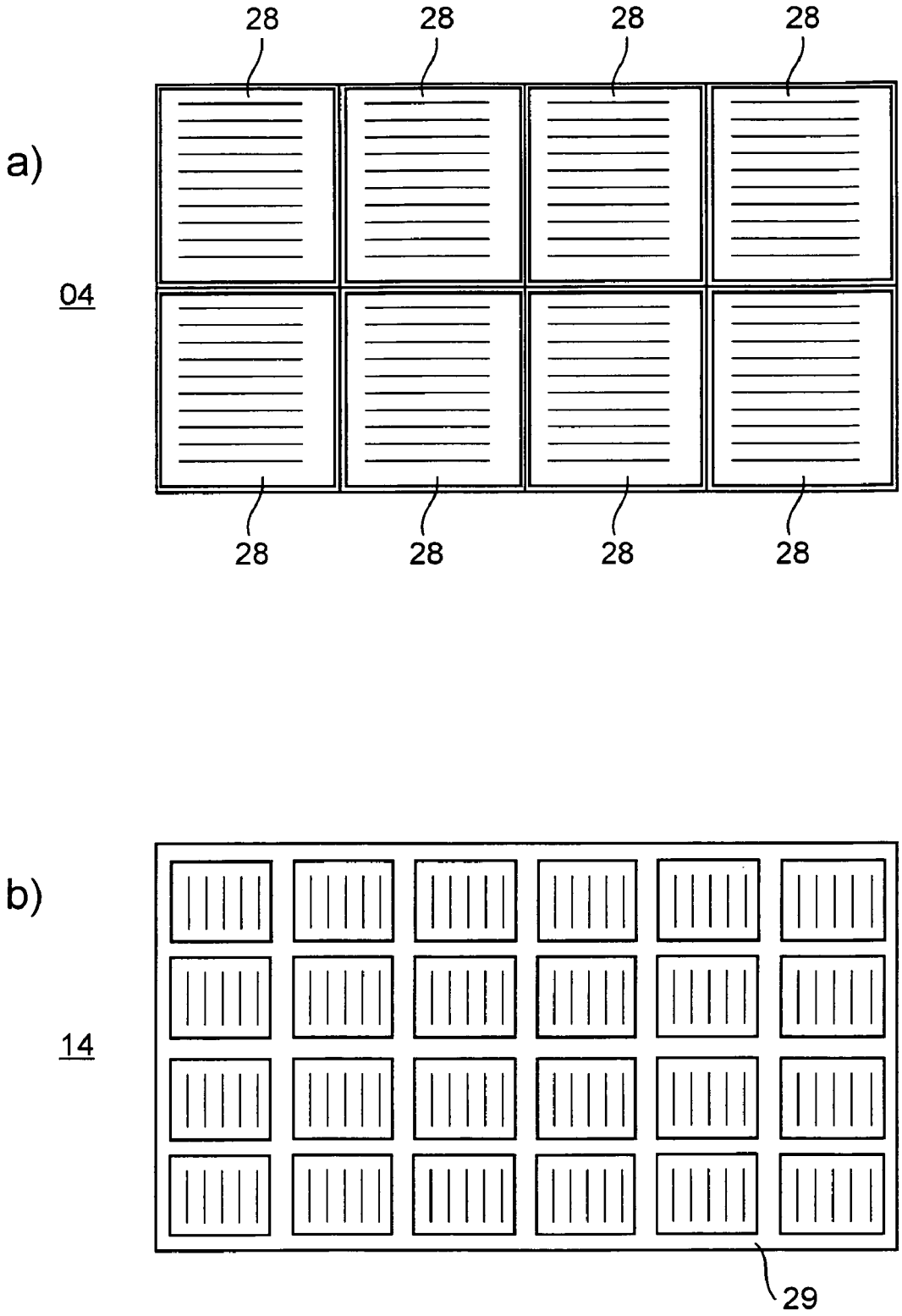
FIG. 2*a*) and FIG. 2*b*) a schematic representation of the loading of a forme cylinder in the newspaper printing operating mode and in the tabloid printing operating modes.

In one advantageous configuration of the one printing press 01 as a "dedicated" newspaper printing press 01, this one printing press 01 has coldset printing units 02 for newspaper printing as the printing units 02 of the first type. With such first printing units 02 configured as coldset printing units 02, and especially configured for newspaper printing, the printing group cylinders 04, which are configured as forme cylinders 04, have, on their circumference, as viewed longitudinally, a plurality of printing formes 28, as seen in FIG. 2*a*, for example, which, in an axial direction, bear either only one print image, and thus have single printing forme 28, which is not specifically shown, or a maximum of two print images, such as a panorama printing forme, for one newspaper page, while circumferentially along the forme cylinder 04 they bear only one of these print images. Thus, the forme cylinder 04, as represented schematically in FIG. 2*a*), bears four printing formes 28 side by side in an axial direction, and, in the case of a double-sized forme cylinder 04, bears two printing formes 28 in a circumferential direction, each such printing forme bearing one print page. Single-sized forme cylinders 04 have only one printing forme 28 of this type in a circumferential direction. The individual printing formes 28 can be replaced individually or also can be replaced together, in pairs, by panorama printing formes, which are two print pages in width. For this purpose, the forme cylinder 04 of the coldset printing unit 02 has, on its circumference, one, in the case of a single-sized forme cylinder 04, or two, in the case of a double-sized forme cylinder 04, channels in tandem extending longitudinally over the entire usable printing length, and usable for the purpose of holding the printing formes 28. The forme cylinder 04 of the coldset printing unit 02 further has, for example, devices, such as registers or axially active stops, for the lateral alignment of four printing formes 28 side by side. The configuration of the forme cylinder 04 for four print pages, which has four print pages or printing formes 28 side by side and four stops, can be correspondingly applied to a forme cylinder 04 with six print pages side by side, giving it six printing formes 28 and six stops.

A printing unit 02, which is configured as a coldset printing unit 02, has an inking unit, which is not specifically shown in FIG. 1, for use in inking the printing forme(s) 28, which inking unit is filled and/or is operated using coldset inks. The coldset ink is characterized by special auxiliary substances, such as, for example, surfactants, wax gelating agents, mineral fillers and the like, which enable the printed web 11 to dry by causing the ink to be absorbed into the paper. This is achieved especially through the special combination of the coldset ink and the paper that is used.

The web 11 that is fed through the coldset printing unit 02 is preferably uncoated or lightly coated paper having a maximum coating weight of 20 g/m$^2$, especially at most 10 g/m$^2$.

In the embodiment of the first printing press 01 as a coldset printing press for newspaper printing, the folder 08, which is assigned, in straight-line travel, to the first printing press 01 with the former assembly 07 that is arranged in the machine alignment M1, is configured, for example, as a newspaper folder. The folder 08, which is configured as a newspaper folder, has one or two folding units, configured, for example, as a single folding unit or as a double folding unit. The folder 08 can also have a plurality of separate folding units. The folding unit of the folder 08, which is configured as a newspaper folder, has, for example, a cutting cylinder, a transport cylinder, a jaw cylinder and, if applicable, a delivery fan. Optionally, however, and especially for the configuration of the folding unit for semi-commercial products, it can also have a capability for forming a second cross fold. The folding unit of the folder 08 is advantageously rotationally driven by at least one drive motor, and is separate mechanically from the printing units 02.

Printing group cylinders 14 of a heatset printing unit 03, primarily for semi-commercial or commercial printing, and which are configured as forme cylinders 14, can, in one configuration, advantageously have preferably only one, but at most two, printing formes 29 on its circumference, as viewed longitudinally. Such printing formes 29, viewed axially, bear, for example, at least three, in the case of two printing formes longitudinally, or six, in the case of only one printing forme 29 longitudinally, print images of a tabloid page, such as, for example, a, magazine or a telephone book page, and, as viewed in the circumferential direction of the forme cylinder 14, bear a plurality, for example, at least four, of these print images. Thus, the forme cylinder 14, as represented schematically in the unrolled circumference shown in FIG. 2 *b*), supports only one printing forme 29, for example, viewed both axially and circumferentially, wherein that only one printing forme, for example, bears the print images of six print pages side by side axially and circumferentially bears the images of four print pages in tabloid format, such as, in magazine or in telephone book format. In the case of two full-circumference printing formes 29 positioned side by side on the forme cylinder 14, for example, the printing formes 29 each have three print pages positioned side by side in tabloid format. For this configuration, the forme cylinder 14 of the heatset printing unit 03 has on its periphery, for example, one channel extending longitudinally over its entire usable printing lengthand usable for the purpose of holding the printing forme(s) 29. The forme cylinder 14 of the heatset printing unit 03 also has, for example, a device, such as, for example, one or more registers or axially active stops, for the lateral orientation of one or two printing formes 29 side by side.

In another configuration, the printing unit 03, that operates using the heatset process, can be configured with its forme cylinder 14 corresponding to a forme cylinder 04 of a coldset printing unit 03, which forme cylinder 14 can support a number of printing formes, such as, for example, individual printing plates, located axially on its circumference, the number of printing formes corresponding to the number of print pages. In the case of a double-width printing unit 03, for example, four printing formes can be placed side by side in an axial direction, and in the case of a triple-width printing unit 03, for example, six printing formes with print pages, for example, in newspaper format, can be so situated.

The forme cylinder 14 of the heatset printing unit 03 can have an effective cylinder width, such as a width that is usable for printing a material web 21, such as, for example, paper web 21, or another material web 21, which effective cylinder width corresponds at least to the corresponding number of newspaper pages of the format to be printed in the newspaper printing press 01.

The heatset printing unit 03 has an inking unit, which is not specifically represented in FIG. 1, for inking the printing forme(s) 29, which inking unit is filled and/or is operated operated using heatset inks in at least one operating mode, typically a heatset mode of operation. The heatset ink is characterized by special oils, such as, for example, mineral oils, which special oils evaporate under the influence of heat, thereby allowing the printed web 21 to dry. The mineral oils, for example, have a boiling range of 220° C.-320° C. Their part by weight can be approximately 25 to 40%, referred to the ink. Because the ink does not need to be absorbed in order to dry, paper surfaces having smaller pores can also be printed on.

The web 21, which, in the heatset process, is fed through the heatset printing unit 03, is preferably satin-finished and/or is more heavily coated paper, typically having a coating weight of more than 10 g/m$^2$, and for example, of at least 15 g/m$^2$. At average or higher quality, the paper can be structured in a base weight range of greater than 40 g/m$^2$, such as, for example, in a base weight range of 55-90 g/m$^2$, and especially greater than 50 g/m$^2$. In contrast, the paper used in the coldset process can advantageously be provided having a base weight range of less than 50 g/m$^2$, and especially less than 40 g/m$^2$.

Preferably, however, the heatset printing unit 03 can be operated in either heatset mode or in coldset mode, as desired. It is operated, for example, in the heatset operating mode using heatset ink and/or using heavily coated paper, and is operated in the coldset operating mode using coldset ink and/or using uncoated or lightly coated paper. In the coldset operating mode, the dryer 15 can be traversed while it is in a deactivated status, or, as indicated by solid lines in FIGS. 16 and 17, the dryer is can be circumvented in a modified web path.

The printing unit 03 of machine line 25, and especially of heatset machine line 25 and/or of the second printing press 31, which is now configured as a heatset printing press and/or as a semi-commercial printing press, is configured, for example, as a printing tower 03, which preferably has four stacked blanket-to-blanket printing groups for double-sided printing, such as, for example, so-called bridge or n-printing units. In principle, however, the printing tower 03 can also have two stacked H-printing units or two stacked satellite printing units, or can be comprised of these.

If the second printing press 31 is configured as a commercial printing press, the second printing unit 03 has an offset blanket-to-blanket printing group with four printing groups cylinders 14; 16 arranged vertically, one above another, and more complicated inking groups, such as, for example, dual-train roller inking groups with at least three friction cylinders located in each roller inking group roller train. The forme cylinders 14 are configured, for example, similar to those that were described above in reference to the heatset printing group, with a continuous printing forme attachment channel and having the option of attaching a printing forme 29 that extends over the entire width. In this case as well, the commercial printing units are operated using heatset ink, and the printing press has a dryer 15.

One or more of these second printing units 03, such as, for example, heatset printing units 03 or a heatset machine line 25, has a folder 18, typically a heatset folder 18, arranged downstream from it. In addition to having a cutting cylinder, a transport cylinder and a jaw cylinder, a heatset folder 18, for semi-commercial products, advantageously has additional units, such as, devices of forming a $2^{nd}$ lengthwise fold and/or a $2^{nd}$ cross fold and/or a stitcher and/or a plough fold.

The at least one second type printing unit 03 is arranged laterally, to the side of the alignment of the first printing units 02, seen from a top plan view, as taken in FIG. 1. This means that, from a top plan view, at least the printing points 41 of this second printing unit 03 are located outside of an alignment which is formed by the effective lengths of the printing group cylinders 04; 06 or the maximum web width of the first printing press 01. In this way, as described below, a web 21 that has been printed by the printing unit 03 of the second type can be fed from the side, transversely with respect to the machine alignment M1 of the first printing press 01, into the flow of webs 11 or of partial webs of the first printing press 01. A second direction of transport T2, projected into the horizontal plane, of a web 21 that has been printed by the printing unit 03 of the second type, and which is running up to the first printing press 01, therefore hits the machine alignment M1 of the first printing press 01, which is projected into the horizontal plane, at a 90° angle, all as depicted in FIG. 1.

The printing press system in accordance with the present invention, and as depicted in FIG. 1, is particularly compact and advantageous, in terms of the number of changes in direction that are necessary, for the at least one printing unit 03 of the second type to be arranged at an angle, and especially at a right angle, relative to the printing unit 02 of the first type or to the first printing press 01. The rotational axes of printing group cylinders 14; 16 of the printing unit(s) 03 of the second type extend perpendicular or orthogonally to the rotational axes of the printing group cylinders 04; 06 of the printing unit(s) 02 of the first type. In this context, the term "perpendicular" or "orthogonal" does not mean that the imaginary straight-line extensions of the rotational axes must intersect; they can also be "skewed" in relation to one another.

A machine alignment M2 that is perpendicular to the axial direction of the printing group cylinders 14; 16 of the printing unit(s) 03 of the second type can have only one printing unit 03 arranged in it. Alternatively, a plurality of printing units 03, with a second printing unit 03 of the second type being indicated by dashed lines, of the second type in the manner of a linear machine, or at least one printing unit 03 and a dryer 15 and/or other units, such as cooling rollers and/or a coating unit may be arranged in machine alignment M2. A configuration of this type, comprising one or more second printing units 03, for example, together with a supplementary dryer 15, and the like, in a machine alignment M2, is also characterized in, the discussion which follows, as machine line 25, and in specific cases also as heatset machine line 25. The second machine alignment M2 and/or the direction of passage of a web through an optionally included dryer 15 is oriented, for example, essentially perpendicular to the first machine alignment M1. With the linear arrangement of the first printing press 01, the axial direction of the printing group cylinders 14; 16 of the second printing unit(s) 03 extends essentially parallel to the machine alignment M1 of the first printing press 01.

In the machine alignment M1 of the first printing press 01, a superstructure 05 with at least one turning device 10 is provided. The turning device 10 is configured such that a web 21 entering into it, from the second printing unit 03 or from the second printing press 31, can be turned 90° into the alignment of a web 11 or of a partial web of the first printing press 01. In other words, with the turning device 10, a web 21 from the second printing press 31 traveling in direction of transport T2 can be turned 90° to a direction of transport T1 that is parallel to the machine alignment M1 of the first printing press 01, and can be fed to the former assembly 07 of the first printing press 01.

Therefore, with the above-described lateral, or angular, arrangement of the two printing presses 01; 31 and/or of the first and second printing units 02; 03 of different types, and with the turning device 10, in addition to a printing unit 02 of the first type, a printing unit 03 of the second type, such as, for example, a heatset printing unit 03, is, or can be assigned to the former assembly 07 of the first printing press 01, in at least one operating mode involving the turning of a web 21 or partial web.

This turning device 10 can be viewed as a turning device 10 for a superstructure 05 that is assigned to this first printing press 01, with turning device 10 being assigned to this first printing press 01 in stand-alone production. However, an additional turning device, not specifically shown here, can also be advantageously assigned in the superstructure 05 to the first printing press 01, to allow the webs 11 or the partial webs 11.1; 11.2; 11.3, which are traveling in the first printing press 01, to be turned variably into different alignments that are parallel to the machine alignment M1. The second printing press 31 can also be equipped, in its superstructure 39, with a turning device that is different from the turning device 10. This makes it possible to turn the webs 21 or the partial webs 21.1; 21.2, which are traveling in the second printing press 31, variably into different alignments that are parallel to the machine alignment M2, as is discussed below.

In addition to the first former assembly 07, another, second former assembly 17 is assigned to the two printing presses 01; 31, as shown in FIG. 1. In one operating mode of the printing press system, stand-alone production can be performed with the one printing press 01 on the one former assembly 07, and with the other printing press 31 on the other former assembly 17. As described above, with the at least one turning device 10, in another operational mode of the printing press system, it is possible to feed webs 11; 21 or to feed partial webs 11.1; 11.2; 11.3; 21.1; 21.2 from the two printing presses 01; 31 together to one former assembly, either 07; 17.

Depending upon the machine width of the two printing press 01; 31 and/or of their printing units 02; 03, or in other words, depending on the maximum web width to be printed and/or the number of pages, such as, for example, newspaper pages, situated axially along the printing group cylinders 04; 06; 14; 16, the two former assemblies 07; 17 can have the same or a different number of fold formers 09; 19, arranged side by side horizontally as a former group. Also, depending upon the products to be chiefly produced on the two printing presses in stand-alone production, the two printing presses 01; 31 can have fold formers 09; 19 of the same or of a different effective width or former format. Thus, for example, the one former assembly, either 17 or 07, can have a group of two fold formers 19; 09 side by side and the other former assembly 07; 17 can have a group of three fold formers 09; 19, each of the same effective width or the same former format, as depicted in FIG. 1. However, it is also possible for one former assembly 07; 17 to have a group of two or three fold formers 09; 19 of a first effective width, in a first former format, while the other former assembly 17; 07 has a group of one or two fold formers 19; 09, each of another, such as, for example, greater effective width in a second former format. The former assemblies 07; 17 can therefore differ in terms of their number and/or effective width of the fold formers 09; 19, as required. In this context, the effective width and/or format of the fold former 09; 19 refers to the width in the run-up area to the fold former 09; 19, transversely to the approaching web 11; 21 or partial web. This corresponds, for example, to the maximum width of a partial web to be folded using this fold former 09; 19, which, in turn, corresponds to the respective print page format to be folded. Generally a partial web is two print pages of the corresponding format in width.

In the case of multiple-width presses, such as, for example, double-width or triple-width printing units 02; 03, a longitudinal cutting device 34; 36 is provided in the web path between the printing unit 02; 03 and the respectively assigned former assembly 07; 17. With a printing unit 02; 03 that is n- or m-times wide, wherein, m=1, 2, 3, . . . , in configuration, the forme cylinder 04; 14 bears 2*n, respectively 2*m print pages of a specific format, and especially of a newspaper format, side by side in an axial direction in one operating mode, for example, and the longitudinal cutting device 34; 36 is structured to cut a web 11; 21 that has been printed by this printing unit 02; 03 lengthwise into at least n or m partial webs 11.1; 11.2; 11.3 or 21.1; 21.2, respectively.

In principle, the respective longitudinal cutting device 34; 36, for each of the two printing presses 01; 31, can be arranged in the web path either upstream or downstream from the turning device 10. In the former case, the already narrow partial webs 11.1; 11.2; 11.3 and/or 21.1; 21.2 are to be fed over guide rollers 13; 20 and/or turning devices 10 to the formers 09; 19. In the latter case, with multiple-width webs 11; 21 a "multiple width" turning bar 32, as will be discussed below, is necessary if the multiple-width web 11; 21 or if a multiple-width partial web 11.1; 11.2; 11.3 or 21.1; 21.2 is not to be moved in a straight line, but instead is to be turned into the machine alignment M1; M2 of the other printing press 01; 31. However, it is also possible, with at least one of the printing presses 01; 31, or even with both, for a longitudinal cutting device 34; 36 to be provided between printing unit 02; 03 and turning device 10, and for a second longitudinal cutting device 34'; 36', which is indicated by dashed lines, to be provided between turning device 10 and former assembly 07; 17. In this case, a web 11; 21 can be cut into partial webs 11.1; 11.2; 11.3 or 21.1; 21.2, which are the width of the former, during straight-line travel shortly before reaching the former assembly 07; 17, whereas in the operating mode that involves an angled web lead or hybrid production, the partial webs 11.1; 11.2; 11.3 or 21.1; 21.2, that are to be turned into the other machine line 25; 30 can be cut before reaching the turning device 10.

In one embodiment, the turning device 10 can be configured such that, as needed, a web 21; 11 coming from only one of the printing presses 31; 01 can be fed to the former assembly 07 of the other printing press 01. In another advantageous embodiment of the turning device 10, it can be configured such that, optionally or simultaneously, one or more webs 21 and/or partial webs from the second printing press 31 can be fed to the former assembly 07 of the first printing press 01, and conversely, one or more webs 11 and/or partial webs from the first printing press 01 can be fed to the former assembly 17 of the second printing press 31.

In one advantageous embodiment, as depicted in FIGS. 1 through 30, the two printing presses 01; 31 or the two machine lines 25; 30, which are oriented perpendicularly or orthogonally to one another, are structured as printing presses 01; 31 for the straight-line travel of printed webs 11; 21. In other words, the former assemblies 07; 17 are preferably oriented such that material webs 11; 21, that are running up to the fold formers 09; 19, have a direction of transport T1; T2 that is projected into the horizontal plane and extends along, or parallel to the machine alignment M1; M2 of the respective machine line 25; 30. In other words, both the webs 11 that have been printed in the printing units 02 of the first type and the webs 21 that have been printed in the printing units 03 of the second type can be fed, in one operating mode, in so-called straight-line travel to the assigned fold former 09; 19.

In this embodiment of the two printing units 02; 03 and/or the two printing presses 01; 31 and/or machine lines 30; 25, which are arranged perpendicular to one another, it is provided that the former assembly 07, which is assigned to the first printing unit 02 or to the first printing press 01, is arranged in the machine alignment M1 for the straight-line travel of webs 11 that have been printed in this machine. The former assembly 17, which is assigned to the other printing unit 03 or printing press 31, and which is perpendicular to the first, is arranged in the machine alignment M2 for the straight-line travel of webs 21 that have been printed in this second machine line 25. In "normal" print operation, such as, for example, with stand-alone production, in which webs 11; 21 of the two different printing units 02; 03 are not to be combined, production can be performed, in each case, in straight-line travel to the assigned former assembly 07; 17. The former assemblies 07; 17 are then also situated orthogonally to one another, in terms of the direction of transport T1; T2 of a web 11; 21 running up to each former assembly 07; 17, with this direction being projected into the horizontal plane. Each of the two printing units 02; 03 or the two machine lines 30; 25, which are oriented orthogonally to one another, is assigned a former assembly 07; 17. The direction of transport T1; T2 of a web 11; 21 running up to this former assembly 07; 17, with this direction being projected into the horizontal plane, extends parallel to the corresponding machine alignment M1; M2 or perpendicular to the rotational axis of the printing group cylinders 04; 06 or 14; 16 of the printing units 02; 03 that are assigned in straight-line travel.

In this configuration, as represented in FIG. 1, a particular configuration can be advantageous, in which in the two printing presses 01; 31, which are positioned orthogonally to one another in terms of their machine alignments M1; M2, the printing units 02; 03 and the former assemblies 07; 17, which are assigned in straight-line travel, are each arranged on different sides of the machine alignment M1; M2 of the respectively other printing press 01; 31, so that, in other words, in the case of stand-alone production, the webs 11; 21 running in straight-line travel intersect on their respective paths to the former assembly 07; 17. In this orthogonal or crossed configuration of a first and a second machine line 30; 25, as seen in FIG. 1, the printing unit 03 and the former assembly 17 of the second machine line 25, which is assigned in straight-line travel, are situated on different sides of the machine alignment M1 of the first machine line 30, as viewed in a horizontal projection. The printing unit 02 and the former assembly 07 of the first machine line 30 or of the first printing press 01, which is assigned in straight-line travel, are situated on different sides of the machine alignment M2 of the second machine line 25 or printing press 31, again as viewed in a horizontal projection. In other words, two webs 11; 21 that have been printed in the two crossed printing presses 01; 31 or machine lines 30; 25 intersect at a right angle, viewed in the horizontal projection, on their path between the printing unit 02; 03 and the respective former assembly 07; 17, which is assigned in straight-line travel. This configuration is also referred to, in the discussion which follows as an X-configuration.

In the X-configuration, such as is depicted in FIG. 1, at least one or more turning devices 10, and a group of guide rollers 13, which are only depicted schematically in FIG. 1, are preferably configured in the area of the point of intersection of the two straight web paths. At least one web 11 or one partial web 11.1; 11.2; 11.3 from a first machine line 30, or first printing press 01, can be optionally fed in a straight line over these guide rollers 13 and/or turning devices 10 to the assigned former assembly 07, or can be turned 90°, on turning bars of the turning device 10, and can be fed to the former assembly 17 of the second machine line 25 or the second printing press 31. Additionally, turning bars in the turning devices 10, or in a second turning device, and a group of guide rollers 20, which are also only schematically depicted in FIG. 1, can be provided such that, via these guide rollers 20 and/or turning devices 10, one or more webs 21 from the second machine line 25 or the second printing press 31 can be either fed in a straight line to the assigned former assembly 17 or optionally can be turned 90° to the former assembly 07 of the first machine line 30 or the first printing press 01. Thus, webs 11; 21 from the machine lines 30 and 25 can be joined together on a former assembly 07; 17 to form a hybrid product.

FIG. 3 through 14 and FIGS. 20 and 21 show additional preferred embodiments of an X-configuration of two printing presses 01; 31 and/or of two machine lines 30; 25, in schematic plan views, in the context of an example of two printing presses 01; 31 and/or of two printing units 02; 03 of different machine widths. In addition, one of the machine lines 25; 30 can have a dryer 15, in this case second printing press 31, and can be configured as a "heatset capable" machine with corresponding equipment, as was discussed above. In the example, the printing units 02; 03 of different types differ at least in terms of machine width, typically, in terms of the effective width of the printing group cylinders 04; 06; 14; 16. One of the printing presses 31; 01 is configured, for example, to be n-times wide, where n=1, 2, 3, . . . , wherein, in one operating mode, the forme cylinder 14; 04 bears 2*n print pages of a specific format, and especially of a newspaper format. The other printing press 01; 31 is configured to be m-times wide, wherein m=2, 3, . . . In this preferred embodiment, m≠n, wherein in one operating mode the forme cylinder 04; 14 bears 2*m print pages of a specific format, such as, for example, a newspaper format, and especially the same format as that of the first-named printing press 31; 01. For purposes of simplicity, only one printing unit 02; 03 per printing press 01; 31 is shown here. However, a plurality of printing units 02; 03, and especially at least two printing units 02; 03, can be provided in at least one of the two printing presses 01; 31, which advantageously is a coldset printing press 01. The at least one turning device 10 is provided in the aforementioned area of intersection.

The terms "single-width", "multiple-width", "double-width", etc. should generally be understood to mean that "single-width" refers to the effective width of the relevant unit or of a web or partial web width corresponding to two print pages, especially to two newspaper pages, arranged side by side. Because, for example, a fold former 09; 19 for a specific format has the width of two print pages, such as, for example, vertical newspaper pages or horizontal tabloid pages, a single-width former assembly 07; 17 corresponds to the width of two print pages and has only one fold former 09; 19, viewed transversely to the direction of web travel, a double-width former assembly 07; 17 has two fold formers 09; 19 side by side, a triple-width former assembly 07; 17 has three fold formers 09; 19 and an n-width former assembly 07; 17 has n fold formers 09; 19, side by side.

Figure 3:
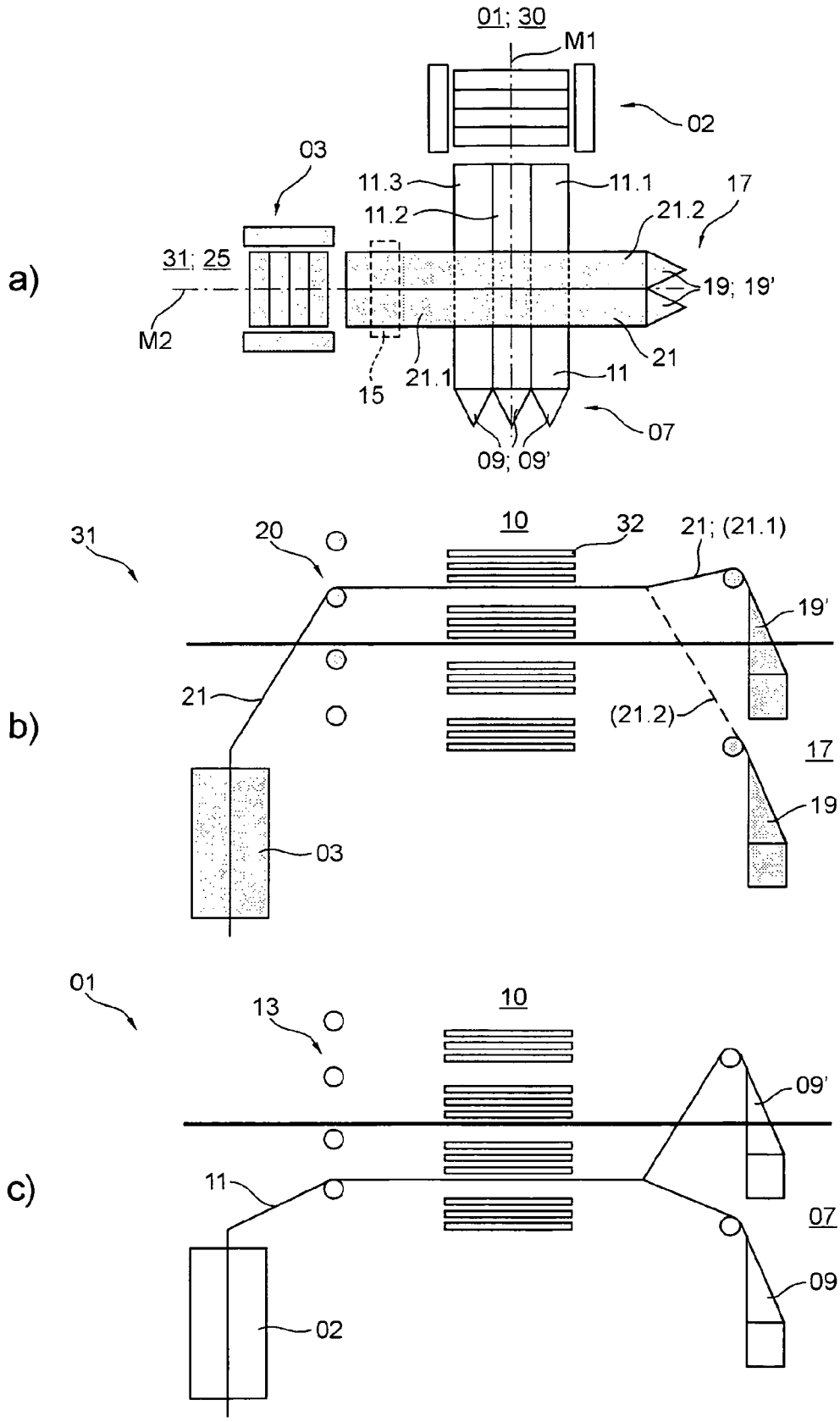
FIG. 3*a*), *b*) and *c*) schematic representations of a further preferred embodiment of a printing press system in accordance with the present invention.

FIG. 3 shows an example of a printing press system with two printing units 02; 03 or machine lines 30; 25 that intersect in the above-described manner, and with two former assemblies 07; 17. In one operating mode, stand-alone production is provided or can be realized with the one printing press 01 on the one former assembly 07 and with the other printing press 31 on the other former assembly 17.

In the example of FIG. 3, the first printing press 01 is configured with triple-width, wherein n=3, printing units 02, and in one operating mode supports six print pages arranged side by side axially along the forme cylinder 04, and especially six newspaper pages in a broadsheet format. In the machine alignment M1, in straight-line travel, a "triple-width" former assembly 07 is situated downstream from these printing units 02, and has a group of three fold formers 09, each two newspaper pages in width, positioned side by side. The other printing press 31 is configured with double-width, wherein n=2 printing units 03 and, in one operating mode, supports four print pages, such as, for example, four newspaper pages, situated side by side axially along the forme cylinder, and especially four newspaper pages in the same broadsheet format as that of the first-named printing press 01. In another embodiment, the printing presses 01; 31 can also be single width combined with double width. In the machine alignment M2, a "double-width" former assembly 17 is situated downstream from the double-width printing units 03 and has a group of two fold formers 19, each being two newspaper pages in width, positioned side by side. The forme cylinders 04; 14 of the two printing units 02; 03 of different widths can both be single circumference, with one print page, and especially with one newspaper page, in circumference, or can be double circumference, with two print pages, and especially with two newspaper pages, in circumference, in configuration. However, one type of forme cylinder 04, such as, for example, the triple-width cylinder 04, can also be configured as double circumference while the other is single circumference. The printing units 02; 03 or printing presses 01; 31 can also differ in other ones of the aforementioned characterizing features, such as printing process, coldset/heatset, coated/uncoated printing substrate, ink type, and the like.

In FIG. 3 through 12, two fold formers 09; 19 or two groups of fold formers 09; 19 or 09'; 19', arranged vertically one above another, are provided for each former assembly 07; 17, by way of example. However, the specified principle of web paths and turns is to be applied, where possible, in the same manner to structures with only one fold former 09; 19 or with only one former group. It is also possible for one former assembly 07; 17 to have only one fold former 09; 19 or only one former group, while the other has two fold formers 09; 19 or two former groups.

In FIG. 3, an operating situation for the two intersecting printing presses 01; 31 is presented, in which operating situation production is performed in stand-alone mode with the one printing press 01 on the one former assembly 07, and with the other printing press 31 on the other former assembly 17. Here, the webs 11; 21 or the partial webs 11.1; 11.2; 11.3; 21.1; 21.2, as shown in FIG. 3 *b*) and 3 *c*), which show in the respective side views of the two printing presses 01; 31 of FIG. 3 *a*), are fed, without turns, to the respective former assembly 07; 17 that is assigned, in straight-line travel. As is indicated in FIG. 3 *b*) by dashed lines, it is also possible for one partial web 21.2 to be fed to a fold former 19 of the one group, while the other partial web 21.1 is fed to a fold former 19' of the other former group, or for both partial webs 21.1; 21.2 to be fed to the lower former group.

Figure 4:
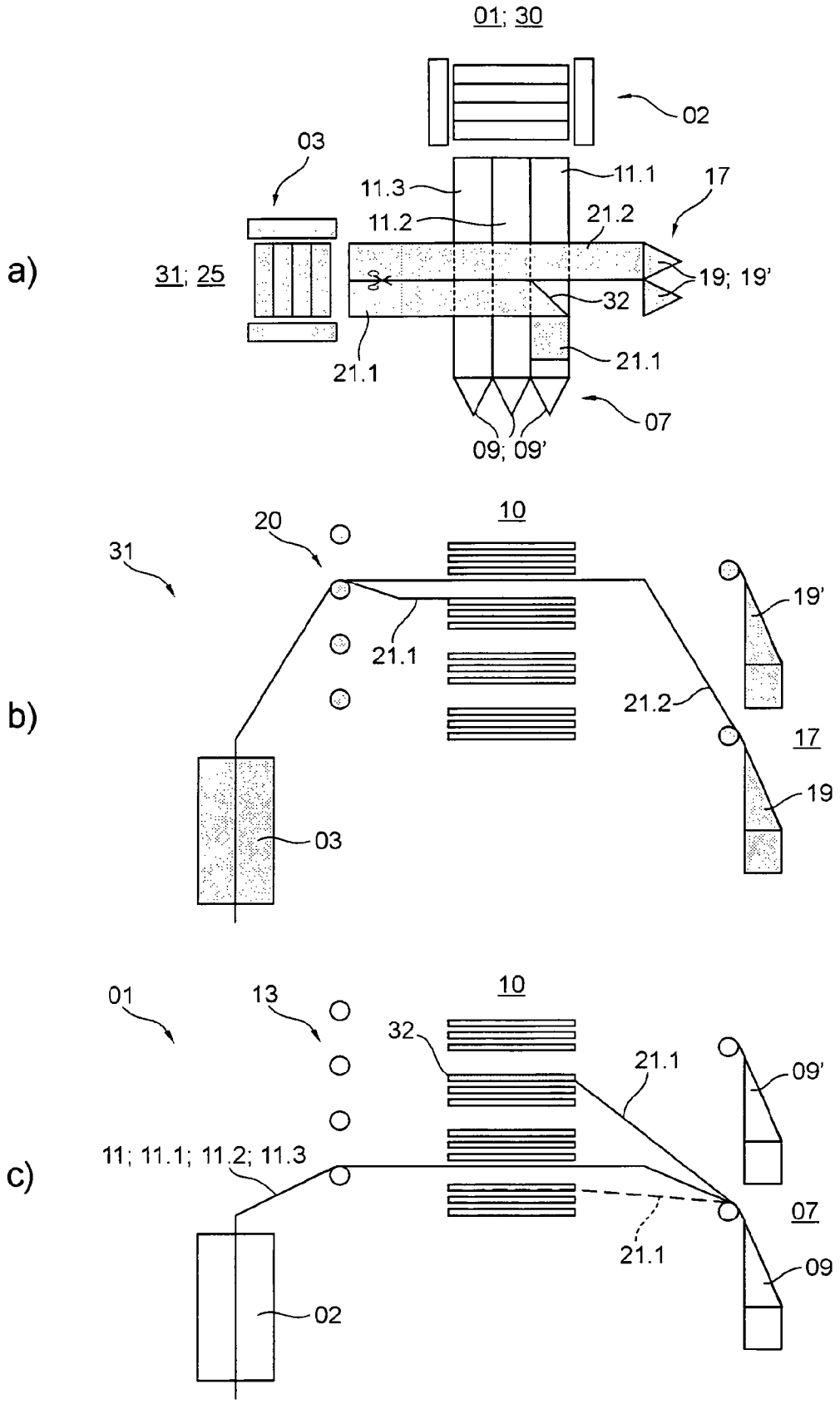
FIG. 4*a*), *b*), and *c*) schematic representations of a further preferred embodiment of a printing press system in accordance with the present invention.

FIGS. 4 *a*) through *c*) show, by way of example, an operating situation involving hybrid production on the former assembly 07 of the first printing press 01 of the first type. A partial web 21.1 from the second printing press 31, which partial web 21.1 is cut lengthwise before reaching the turning device 10, is turned 90° over a guide element 32, such as, for example, a turning bar 32 of the turning device 10, and is directed into the alignment of a partial web 11.1 from the first printing press 01. To accomplish this, the superstructure 05 has the turning devices 10 and at least the one group of guide rollers 13. The turning device 10, such as, for example, a turning deck 10, has a group of a plurality of turning bars 32, which are arranged one above another, positioned in different planes. Advantageously, at least some of the group of turning bars 32 correspond, in terms of the position of their planes, with at least two guide rollers 13 of the group of guide rollers 13, in such a way that the web 21 or the partial web 21.1, which is optionally fed over one of three turning bars 32, which are arranged one above another, can come to lie either above, as seen in FIG. 4 *c*), in solid lines or below, as seen in FIG. 4 *c*), in dashed lines, a web 11 or a partial web 11.1; 11.2, 11.3 that has been printed in the first printing presses 01. The partial web 21.1, which is represented by the solid lines, can also be fed to a fold former 09' of the upper former group. The other partial web 21.2 can either also be turned to an alignment of a partial web 11.1; 11.2; 11.3 or of fold former 09; 09' of the other printing press 01, or, as shown here, can be fed to the former assembly 17 in straight-line travel. The reference symbols used in FIG. 4 will be understood as being transferred to the subsequent figures.

In another configuration, for each partial web 21.1; 21.2 from the second printing press 31 that is to be turned, a single turning bar 32 can be provided in the turning device 10, with the height of this single turning bar 32 bar corresponding to four rollers from the group of guide rollers 13 in such a way that, depending upon the guidance of two webs 11.1; 11.2, 11.3 that have been printed in the first printing presses 01, these alternatively both come to lie above the turned web, both lie below or one lies below and one lies above the turned web 21.

Figure 5:
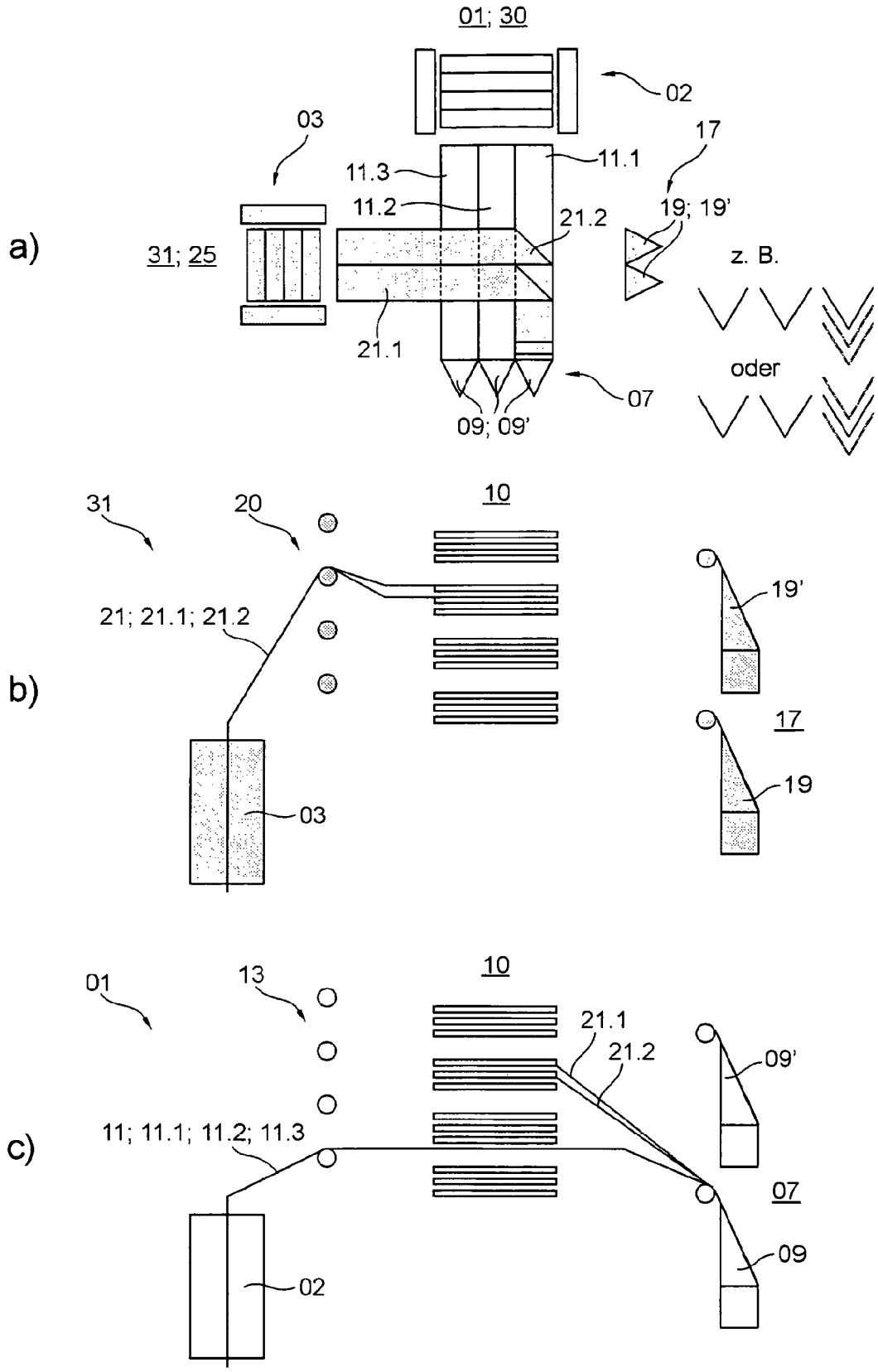
FIG. 5*a*), *b*), *c*), *d*) and *e*) schematic representations of a further preferred embodiment of a printing press system in accordance with the present invention.
Figure 5:
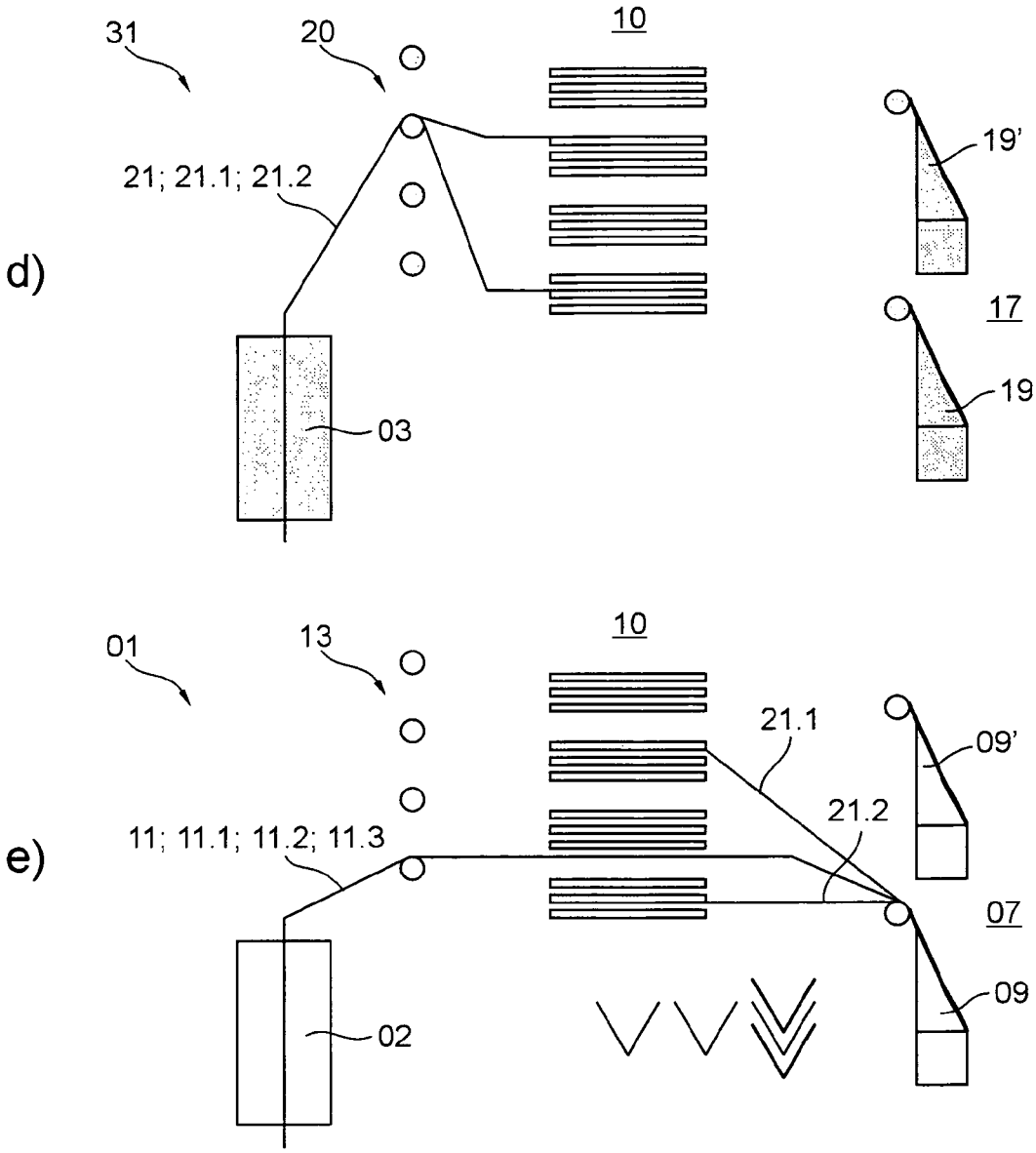

In FIG. 5, in contrast to the configuration of FIG. 4, the two partial webs 21.1; 21.2 from the printing unit 03 are cut before entering the turning device 10 and are each turned 90° into alignment with single a partial web 11.1 of the first printing unit 02. These can separately, each on one of the former groups, both on the upper former group, or, as shown in FIG. 5 *c*), both be combined with the ribbon from the first printing unit 02 on the lower fold former 09. In the example of FIG. 5 *b*) and c), the two partial webs 21.1; 21.2 from the second printing unit 03, such as, for example, the heatset printing unit 03, are fed as upper sections to the ribbon from the first printing unit 02, such as, for example, the coldset printing unit 02, thus forming the outer sections of the folded product ribbon after longitudinal folding. In contrast to this, in the example of FIG. 5 *d*) and e), one partial web 21.2 is turned below and one partial web 21.1 is turned above the web 11 or partial webs 11.1; 11.2; 11.3 from the first printing unit 02, so that the partial webs 21.1; 21.2 from the second printing unit 03 form the outer and inner sections.

Figure 6:
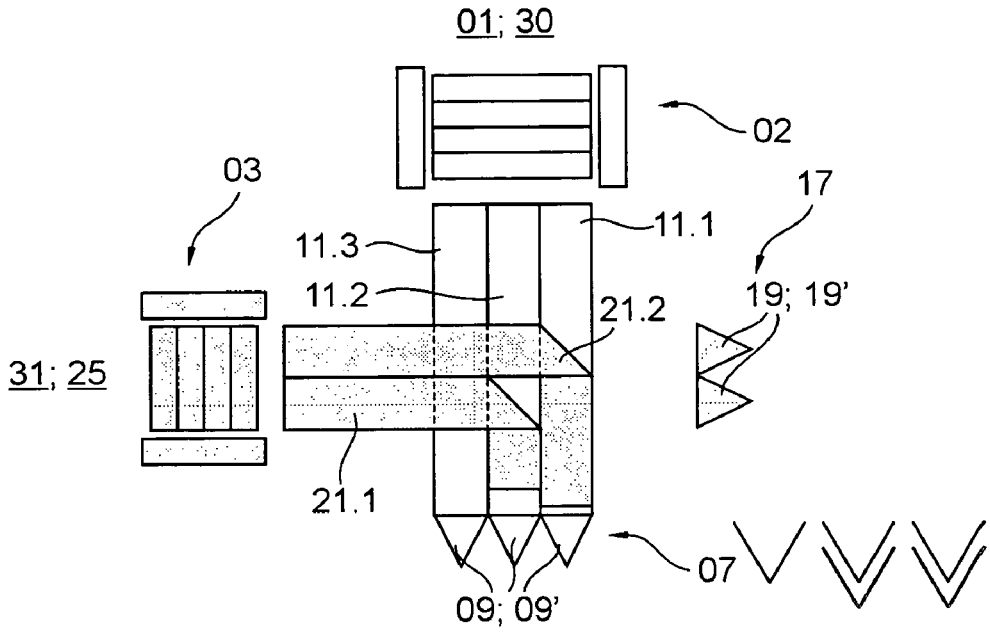
FIG. 6 a schematic top plan view of a further preferred embodiment of a printing press system.
Figure 7:
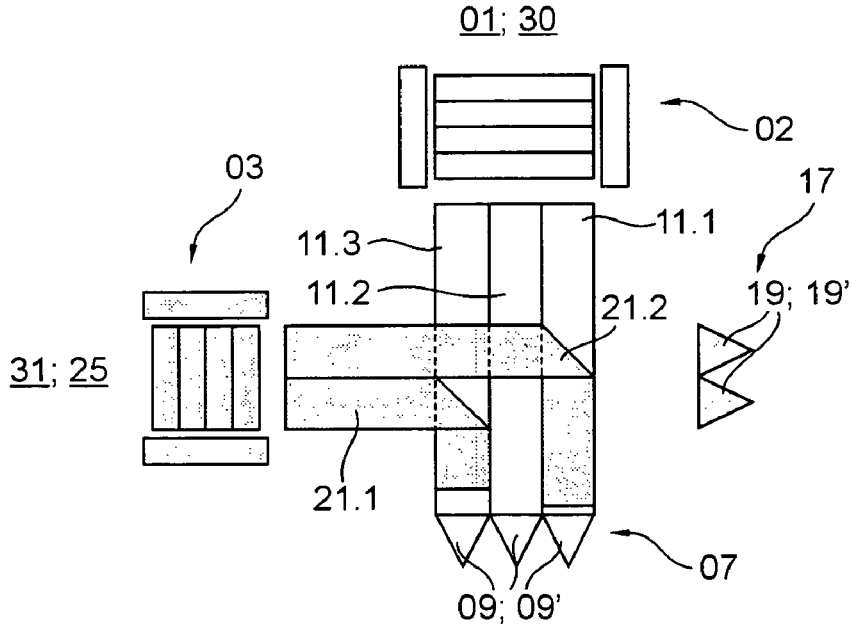
FIG. 7 a schematic top plan view of a further preferred embodiment of a printing press system.

In the example of FIGS. 6 and 7, in contrast to FIGS. 4 and 5, the partial webs 21.1; 21.2 from the second printing unit 03 are turned, not into the same alignment, but into different alignments of partial webs 11.1; 11.2; 11.3 from the first printing unit 02.

Figure 8:
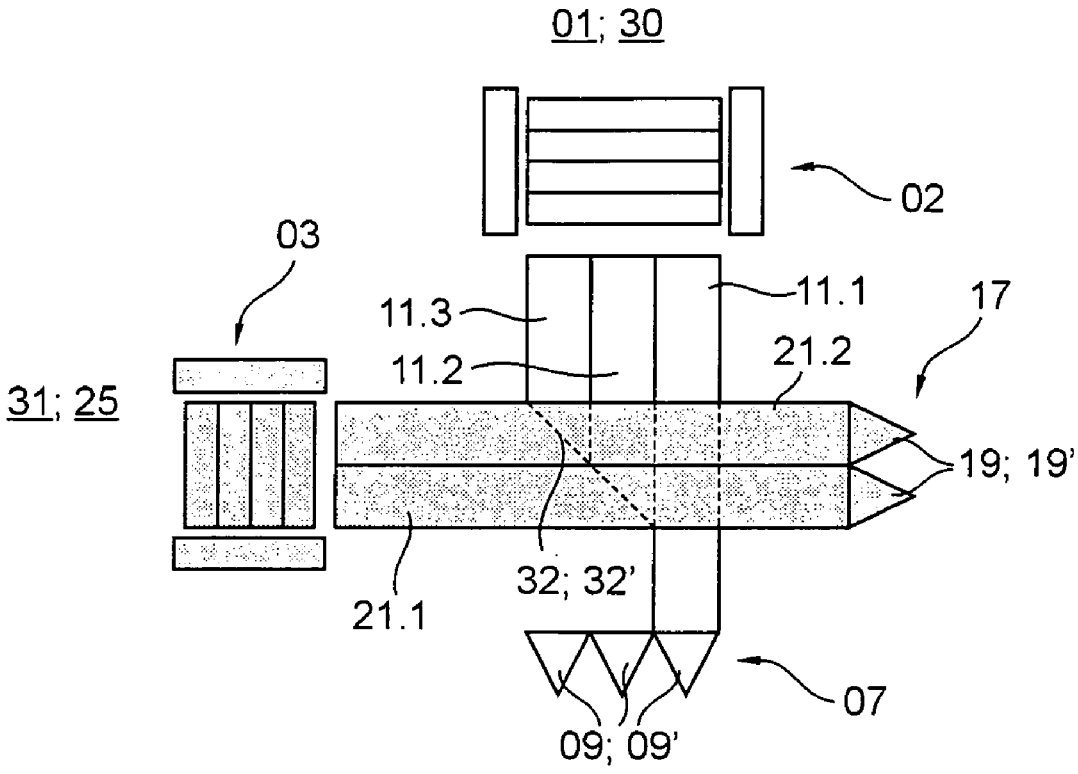
FIG. 8 a schematic top plan view of a further preferred embodiment of a printing press system.

FIG. 8 shows an example of an operating situation, in accordance with the present invention, and involving hybrid production on the former assembly 17 of the printing press 31 of the second type. A single- or a multiple-width partial web 11.2 from the first printing press 01, which is cut lengthwise before reaching the turning device 10, is turned 90° on a turning bar 32; 32' of the turning device 10, and is fed into the alignment of a single- or of a multiple-width partial web 21.1; 21.2 from the second printing press 31. In the example presented in FIG. 8, a multiple-width partial web 11.2, 11.3 or two single-width partial webs 11.2; 11.3 from a first full web 11 and coming from a wider printing press 01, are brought to partial webs 21.1; 21.2 from a second, full web 21, which is coming from a narrower printing press 31. The web width of the uncut, first web 11 is greater than the web width of the uncut second web 21. Here, the other partial web 11.1 runs, for example, in straight-line travel, to a fold former 09; 09' of the first printing press 01. In concrete terms, one or more partial webs 11.1; 11.2; 11.3 from a triple-width web 11 are turned 60° into the alignment of a double-width printing press 31 or to an only double-width former assembly 17. In general terms, a partial web 11.1; 11.2; 11.3 from an n-width web 11 is turned 90° into the alignment of an n−1-width printing press 31 and/or is fed to an n−1-width former assembly 17.

Figure 9:
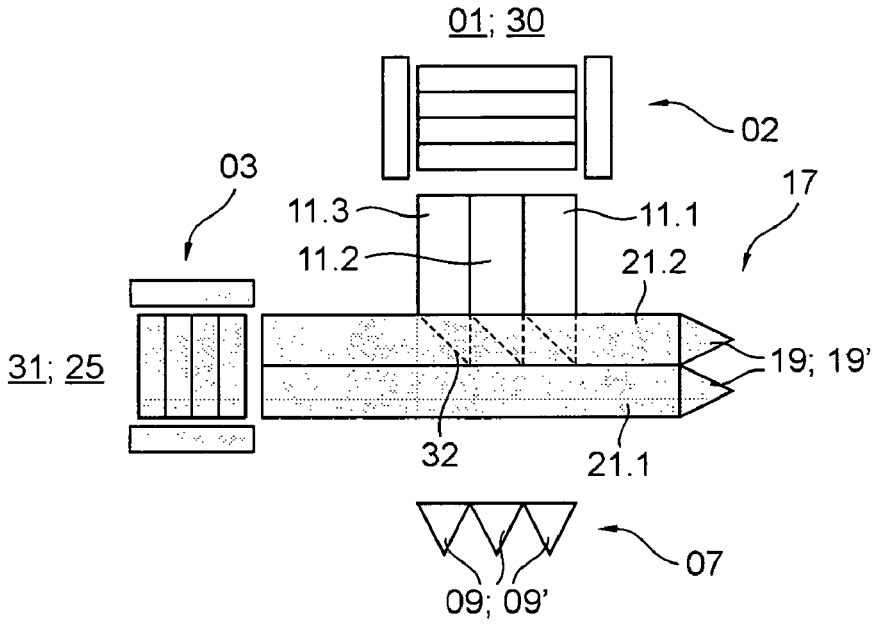
FIG. 9 a schematic top plan view of a further preferred embodiment of a printing press system.
Figure 10:
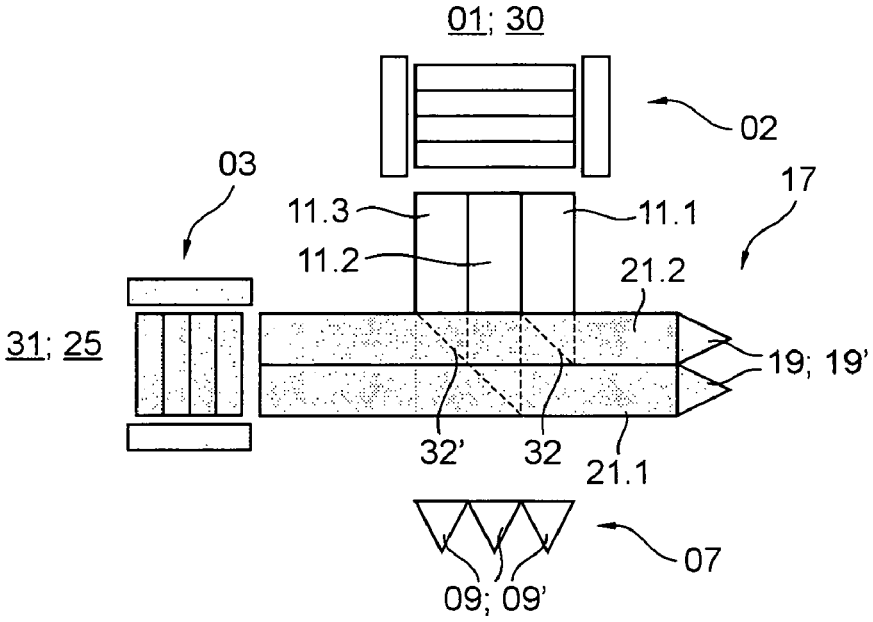
FIG. 10 a schematic top plan view of a further preferred embodiment of a printing press system.

In FIGS. 9 and 10, in contrast to the hybrid production of FIG. 8, all of the partial webs 11.1; 11.2; 11.3 from the wider first printing unit 02 are turned 900 and are fed to the narrower former assembly 17 of the second printing press 31. To accomplish this end, in FIG. 9 the partial webs 11.1; 11.2; 11.3 are cut before entering the turning device 10, and are brought into the alignment of a partial web 21.2; 21.1 of the second printing press 31 via three, especially single-width turning bars 32, and are combined with partial webs 21.1; 21.2 from the second printing press 31 and fed to the former assembly 17 of the second printing press 31. By correspondingly positioning the preferably movable turning bars 32, the partial webs 11.1; 11.2; 11.3 can be placed in various alignments with reference to the partial webs 21.1; 21.2.

In FIG. 10, two partial webs 11.1; 11.3 are brought into the same alignment of the partial webs 21.2 or 21.1 of the second printing press 31, and the third partial web 11.2 is brought into a different alignment of the partial web 21.1 or 21.2. A multiple-width web 11 or a partial web 11.2; 11.3 can be turned using a multiple-width, and in this case, using a double-width, turning bar 32'. The longitudinal cut between this multiple-width, partial web 11.2; 11.3 can then only be made, for example, downstream from the turning device 10. In some circumstances this provides a more stable web path.

Figure 11:
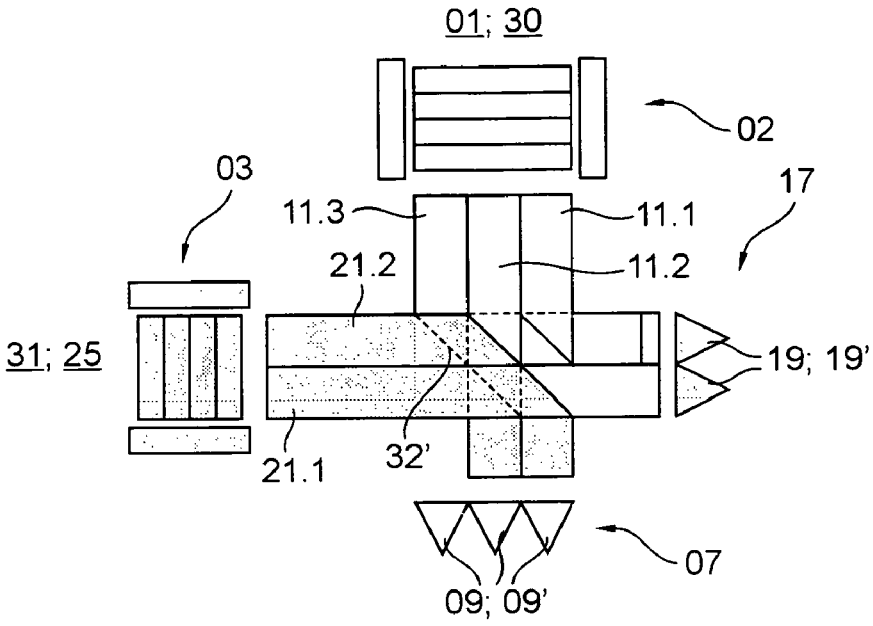
FIG. 11 a schematic top plan view of a further preferred embodiment of a printing press system.
Figure 12:
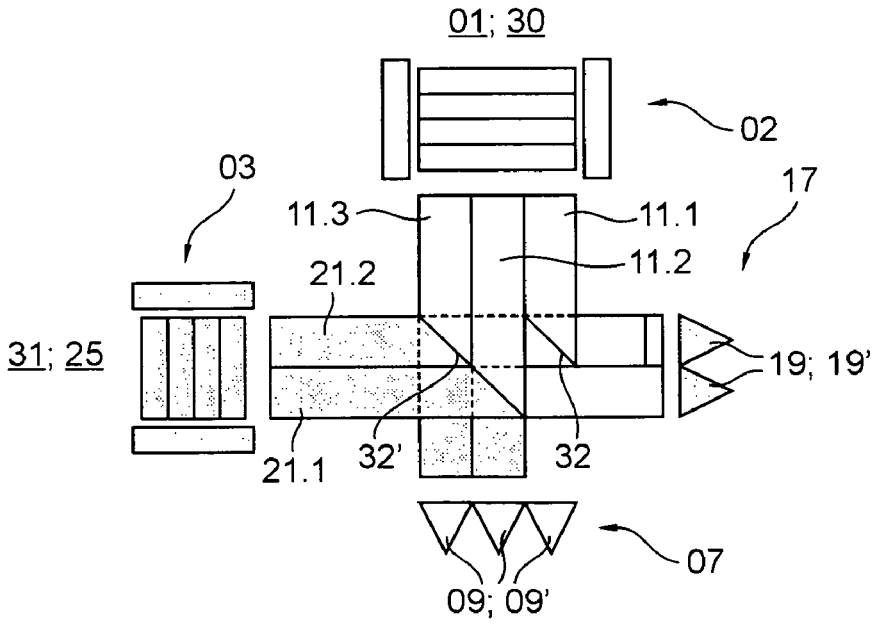
FIG. 12 a schematic top plan view of a further preferred embodiment of a printing press system.

FIGS. 11 and 12 show further examples of a stand-alone production process. The partial webs 11.1; 11.2; 11.3 from the first printing unit 02 are turned to the former assembly 17 that is located in the alignment of the second printing unit 03. The partial webs 21.1; 21.2 from the second printing unit 03 are turned to the former assembly 07 that is located in the alignment of the first printing unit 02. This can make sense in cases in which the folders 08; 18, which are located downstream and which are not specifically shown here, have a different configuration, such as, for example, a coldset folder, or a heatset folder, and, for special products from the first printing press 01, the folder 18 of the second printing press 31 is to be used, and vice versa.

Figure 13:
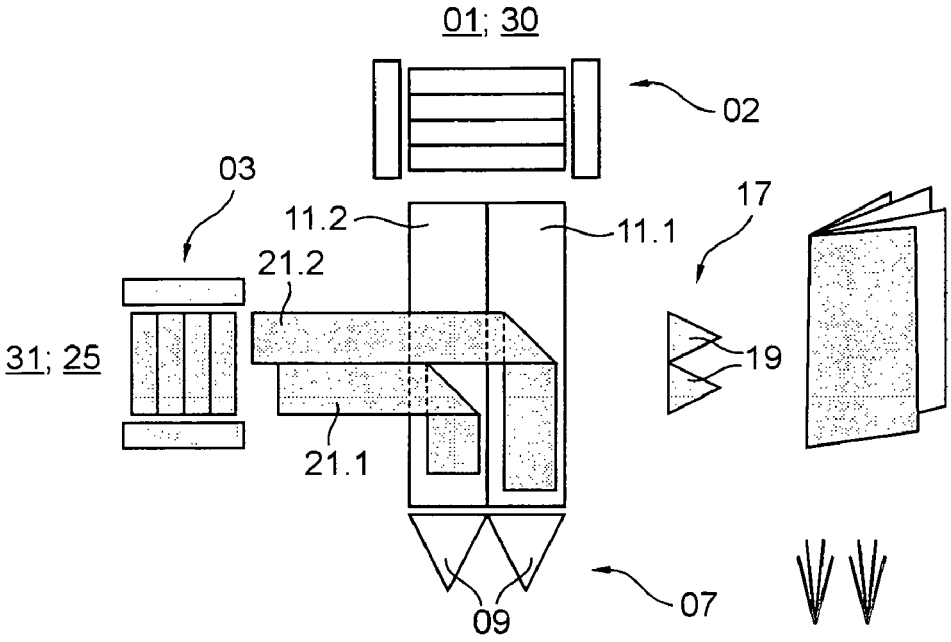
FIG. 13 a schematic top plan view of a further preferred embodiment of a printing press system.
Figure 14:
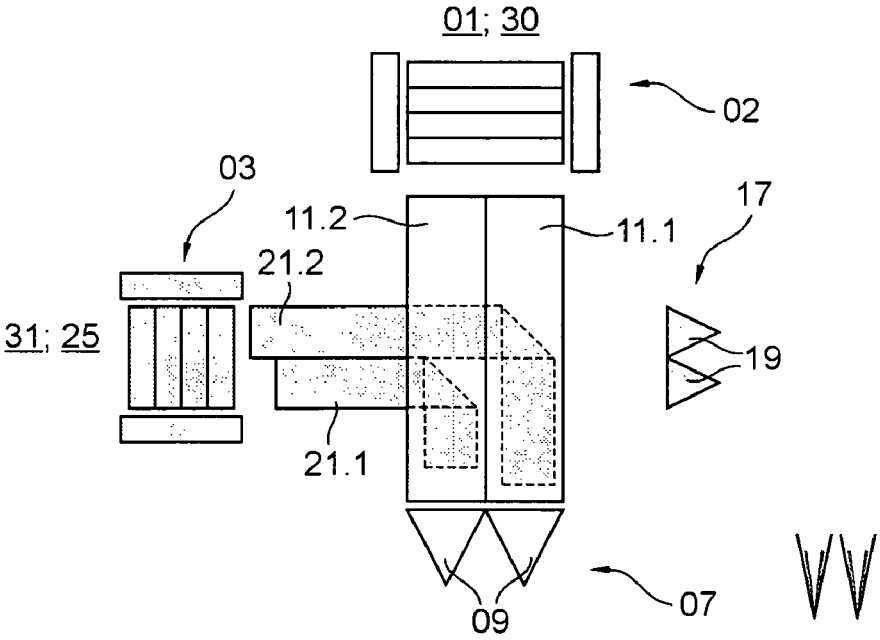
FIG. 14 a schematic top plan view of a further preferred embodiment of a printing press system.

FIGS. 13 and 14 are additional examples of a printing press system in an X-configuration. The one first printing press 01 is configured or is operated as an n-width, and in this case as a double-width, printing press 01 with an n-width, in this case double-width, former assembly 07, based upon a first print page format. The second printing press 31 is configured or is operated as an m-width, with m=n, in this case double-width, printing press 31 with an m-width, with m=n, double-width former assembly 17, which is based upon a second, for example, smaller, print page format. Accordingly, the web 11 is printed in the first printing unit 02 with wider print images than is the web 21 which is printed in the second printing unit 03. The partial webs 11.1; 11.2 from the first printing unit 02, which have been formed by a lengthwise cut of web 11, and each having two print pages of the larger format side by side, are therefore wider than the partial webs 21.1; 21.2 from the second printing unit 03, which are formed by a lengthwise cut of web 21 and which have two print pages of the smaller format, side by side. If the partial webs 11.1; 11.2; 21.1; 21.2 of different widths are joined and are folded lengthwise on a fold former 09, an extension of the wider partial web beyond the narrower partial web product is formed on at least one side of the ribbon for illustration see FIG. 13, right side. The lateral extension of the one typically wider partial product can advantageously also be printed, and can provide a reader with information or with directional assistance, even when the end product is unopened.

The first printing press 01 can also be configured such that the first printing units 02 can optionally be operated at n-width of the larger format and n+1-width of the smaller format, as, for example, in FIG. 3 or 4. In this case, as described in greater detail below, a group of wider fold formers and a group of narrower fold formers 09; 09' can be provided in one former assembly 07.

Figure 15:
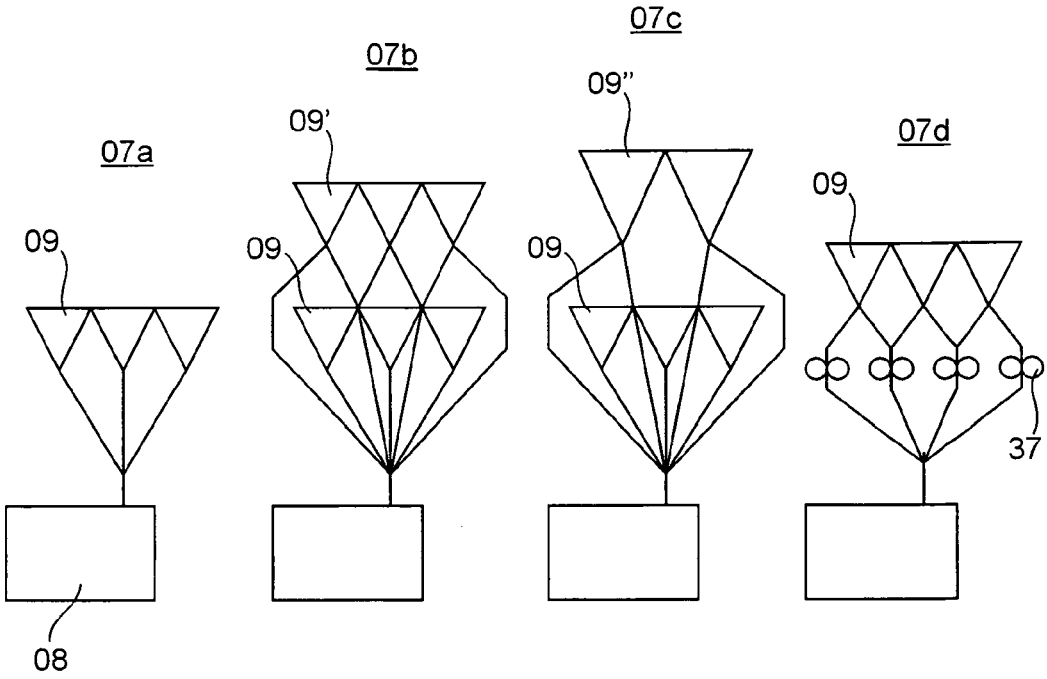
FIG. 15 schematic representations of former assemblies.

FIG. 15 shows various alternatives for the configurations of a triple-width former assembly 07, at least in a certain printed page format. The configuration of the former assembly 07*a*, as shown in FIG. 15, has one former group comprised of three fold formers 09 arranged side by side, transversely to the lead-in direction of a web 11, within a single plane. The effective width of these three fold formers 09 corresponds, for example, maximally to the effective cylinder length of a forme cylinder 04 of the first printing unit 02 that is located upstream from the former assembly 07 in straight-line travel. The folder 08 is located downstream from the former group. In the configuration of the former assembly 07*d*, shown in FIG. 15, the assembly also has longitudinal cutting devices in the web path, which longitudinal cutting devices are not shown here, and which are located upstream or downstream from the fold formers 09, and are usable for the centered, longitudinal cutting of the partial webs 11.1; 11.2; 11.3 in the area of the fold line of the longitudinally folded ribbon. These partial ribbons from the same fold former 09, which are opened up along the fold line and are placed one upon another, can then be separated and can be combined, as needed, with a ribbon or with a partial ribbon from an adjacent fold former 09 via guide rollers and/or nip rollers 37. This is particularly advantageous if an additional processing step, such as, for example, a gluing device or a stitching device, is/are arranged on one or more of the possible ribbon guides between the fold formers 09 and the folder 08. In this manner, and depending upon the distribution of the ribbons, the partial ribbons can be variably assigned to various ones of stitched/unstitched and/or of glued/unglued ribbons.

In the configuration of the former assembly 07*b* of FIG. 15, the assembly has two former groups of three fold formers 09; 09' each, located side by side, in vertical planes that are offset from one another.

In the configuration of the former assembly 07*c* shown in FIG. 15, the assembly has two former groups, arranged one above the other, with different numbers of fold formers 09; 09" arranged side by side horizontally as former groups, and/or with two groups of fold formers 09; 19, each having a different effective width or format. For example, a first of the groups is of triple width in configuration with respect to a first print page format, and with respect to this print page format, has three single-width fold formers 09. The second group is double width in configuration with respect to a second, for example, larger print page format, and with respect to this second print page format, has two single-width fold formers 09". The group having the larger number of fold formers 09, for example, has an overall effective width, which, for example, corresponds to the maximum effective cylinder length of a forme cylinder 04 of the printing unit 02, and which is located upstream from the former assembly 07 in straight-line travel. The wider fold formers 09", in contrast, have a significantly greater effective width, such as, for example, by a factor of 1.1, and especially by a factor of 1.2, than the fold formers 09 of the first group. This former arrangement of the former assembly 07*c* of FIG. 15 is especially advantageous in conjunction with printing presses 01 that are equipped for the printing of variable web widths and/or for producing products of different print page formats. This arrangement is also advantageous for the production of so-called "pop-up" products, using the two combined printing presses, as is represented, by way of example, in FIGS. 13 and 14. A pop-up product is characterized in that in the folded or the compiled product, one product part has a greater width and/or length than another product part, so that an extension of one product section, in relation to another product section, is produced. This extended section of the finished product is advantageously at least 10 mm, and especially is at least 20 mm wide and preferably contains a portion of a print image, such as, for example, text.

Figure 16:
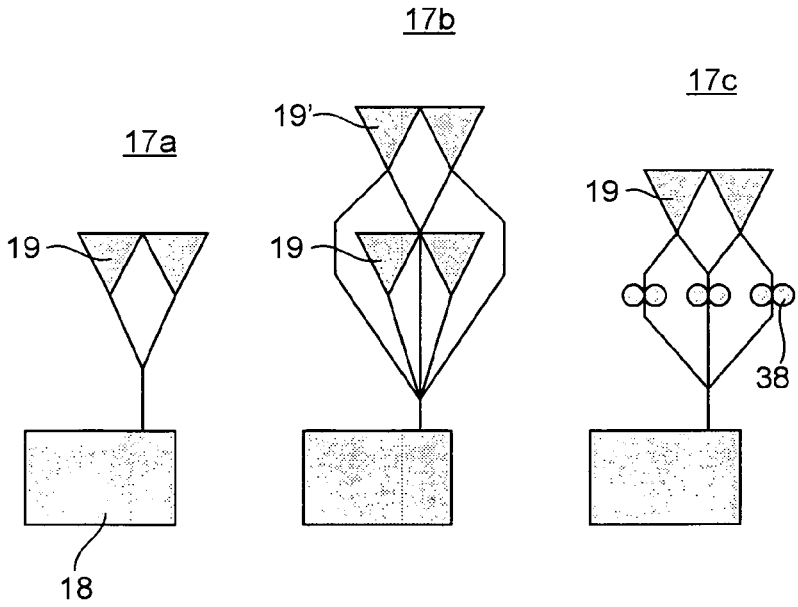
FIG. 16 additional schematic representations of former assemblies.

FIG. 16 shows various alternatives for the configurations of a double-width former assembly 17, at least in a certain print page format. The configuration of former assembly 17*a* of FIG. 16 has a former group, which is comprised of two fold formers 19 arranged side by side, and transversely to the run-up direction of a web 21, in a single plane. The effective width of these two fold formers 19 corresponds, for example, maximally to the effective cylinder length of a forme cylinder 14 of the printing unit 03 that is located upstream from the former assembly 17, in straight-line travel. The folder 18 is located downstream from the former group. In the configuration of the former assembly 17*c* of FIG. 16, the former assembly also has longitudinal cutting devices, which are not specifically shown in FIG. 16, and which are located in the web path, upstream or downstream from the fold formers 19, and which are usable for the centered, longitudinal cutting of the partial webs 21.1; 21.2, in the area of the fold line of the longitudinally folded ribbon. These partial ribbons from the same fold former 19, which are opened up along the fold line and which are then placed one upon another, can then be separated and can be combined, as needed, with a ribbon or with a partial ribbon from an adjacent fold former 19 via guide and/or nip rollers 38. This arrangement is particularly advantageous if an additional processing step, such as, for example, a gluing device or a stitching device, is or are arranged on one or more of the possible ribbon guides, between the fold formers 19 and the folder 18. In this manner, and depending upon the distribution of the ribbons, the partial ribbons can be variably assigned to stitched or unstitched and/or to glued or unglued ribbons.

In the configuration of the former assembly 17*b*, as seen in FIG. 16, the assembly has two former groups of two fold formers 19; 19' each, side by side, in vertical planes that are offset from one another.

In a configuration of the former assembly 17 that is not shown, and according to the principle of FIG. 15, former assembly 07*c*, the former assembly can also have two groups which are arranged one above another, with different numbers of fold formers arranged side by side horizontally as former groups, and/or with two groups of fold formers having different effective widths, or a different former format. For example, a first of the groups of fold formers is double width in configuration, in terms of a first print page format, and, with respect to this print page format, has two single-width fold formers 19. A single, significantly wider fold former, or a group of two wider fold formers 19; 19' is arranged above or below this. In this arrangement, the effective width is as specified in relation to former assembly 07*c* of FIG. 15. With a configuration of this type for the former assembly 07, a pop-up product can also be produced in conjunction with the two printing presses 01; 31.

Figure 17:
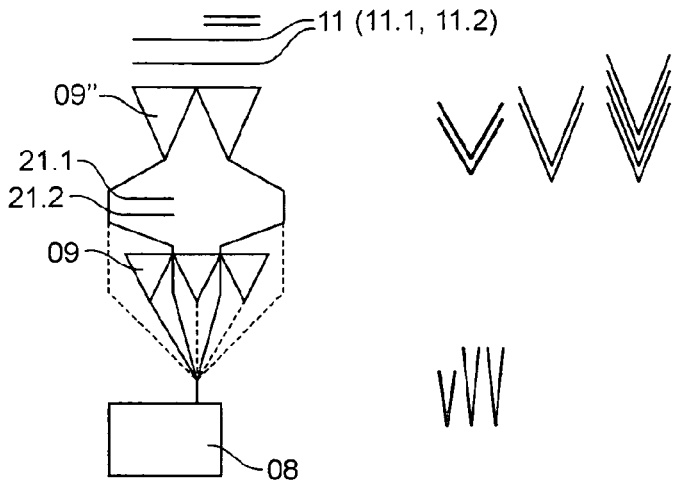
FIG. 17 a schematic representation of a web or ribbon lead for producing "pop-up products"
Figure 18:
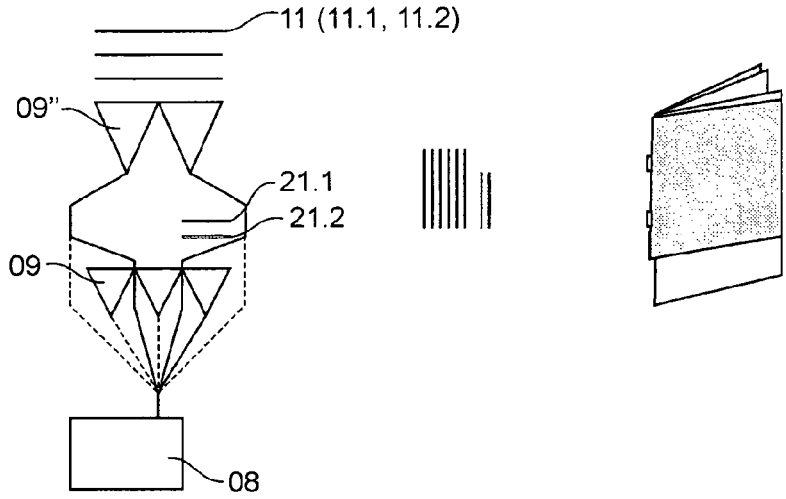
FIG. 18 a further schematic representation of a web or ribbon lead for producing "pop-up products"
Figure 19:
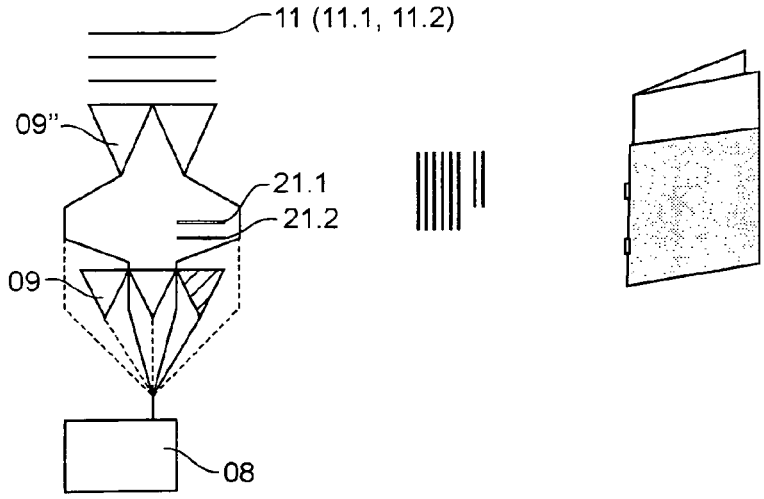
FIG. 19 a further schematic representation of a web or ribbon lead for producing "pop-up products"

In FIG. 17 through 19, examples are provided of web or ribbon guides in accordance with the present invention for producing pop-up products, using the two printing presses 01; 31. For example, the wider partial webs 11.1; 11.2 coming from the one printing press 01, configured, for example, as a coldset printing press, are fed, for example, in straight-line travel, to the former group having the wider fold formers 09", as may be seen, for example, in FIG. 13. The narrower partial webs 21.1; 21.2 from the narrower printing press 31, such as, for example, from the heatset printing press, are fed to the former group having the narrower fold formers 09. FIG. 17, at the right of the figure, shows the three partial products that are produced, for purposes of illustration, as shown in the upper depiction with individual sections, and in the lower depiction with only the partial products.

In FIGS. 18 and 19, two examples of the ribbon feed for producing the tabloid products, each illustrated respectively to the right, in each respective figure, are provided. In these examples, in the finished, folded product of FIG. 18, the extended section of the larger format is in the lower area of the product, and in FIG. 19. This extended section is in the upper area of the product, assuming the spine of the fold is on the left side. To produce the extended section in the upper area of the product, in one advantageous embodiment, at least the fold former 09 of FIG. 19, as indicated by crosshatching, or its former nose is configured to be movable in a direction along or parallel to the machine alignment.

Figure 20:
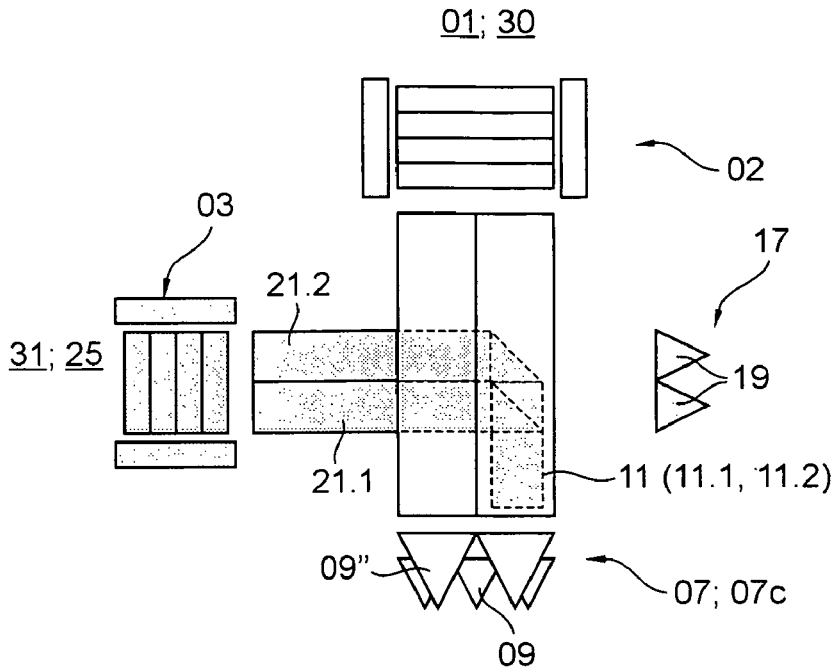
FIG. 20 a schematic top plan view of a further preferred embodiment of a printing press system.

FIG. 20 shows a top plan view of an example of an arrangement of two intersecting printing presses 01; 31. One of the former assemblies 07; 17, and in this case the former assembly 07, is configured in the manner of the former assembly 07*c* of FIG. 15, with two groups of fold formers 09; 09" of different numbers and/or widths. Taking only one web 11 into account and/or view, this top plan view would correspond to a former intake that is comparable to that of FIG. 18.

Figure 21:
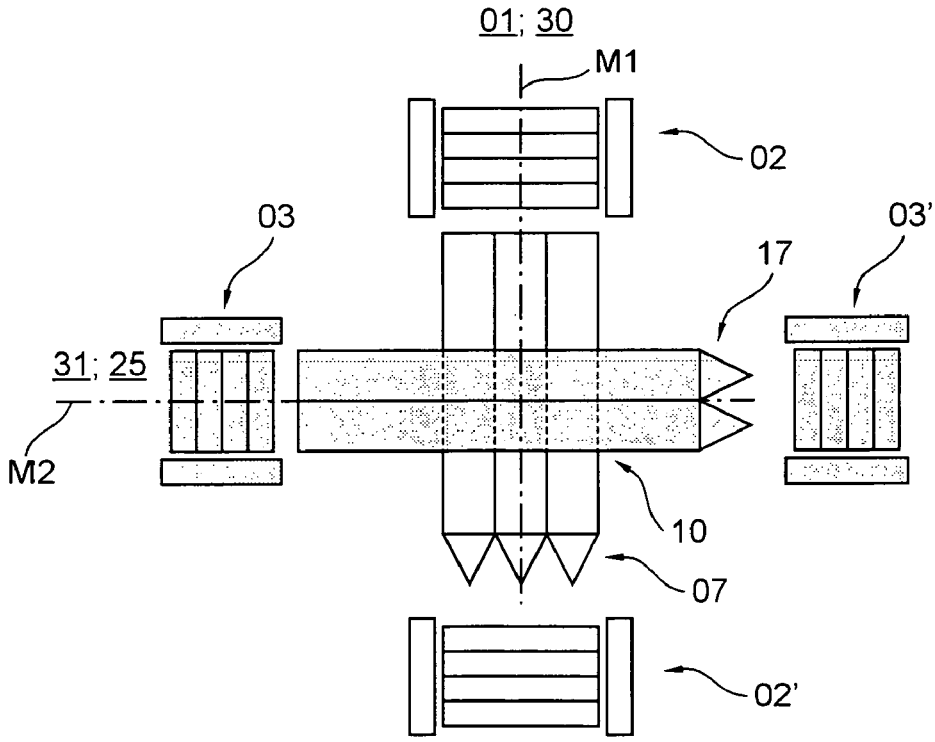
FIG. 21 a schematic top plan view of a further preferred embodiment of a printing press system.

FIG. 21 shows a further improvement of a combination of two printing presses 01; 31 in an X-configuration. In contrast to FIG. 1 or 3, and with a plurality of printing units 02; 02'; 03; 03' per printing press 01; 31, two printing units 02; 02'; 03; 03' are arranged in the respective machine alignment M1; M2 on opposite sides of the turning device 10. Webs 11; 21 from these second printing units 02; 02'; 03; 03', which are arranged on the opposite side of the turning device 10, can also be turned "backwards", in straight-line travel, to the former assembly 07 that lies between the two printing units 02; 02'; 03; 03' of the same machine alignment M1; M2, or can be turned 90°, via the turning device 10 to the other former assembly 17.

Figure 22:
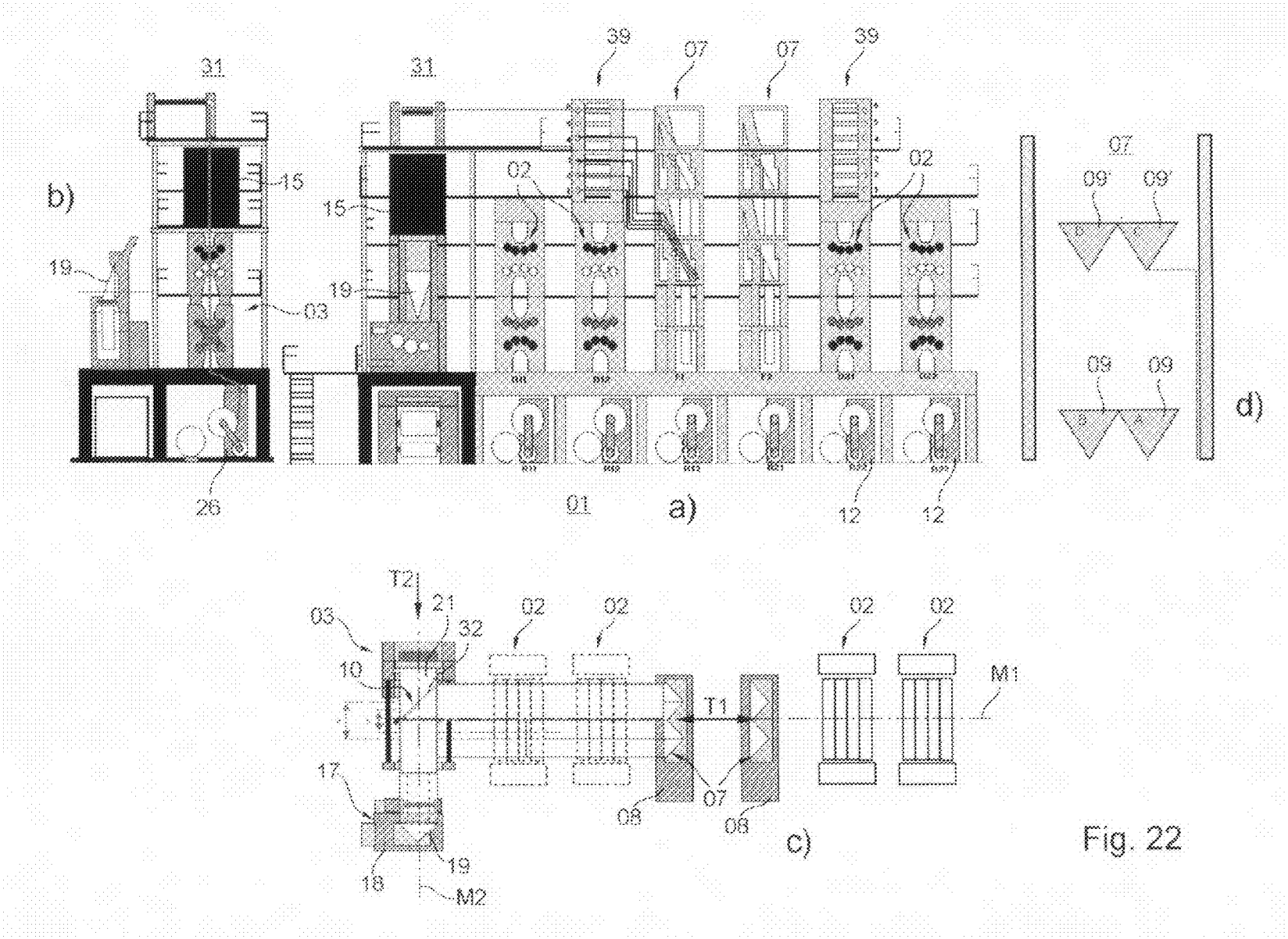
FIG. 22*a*), *b*), *c*) and *d*) schematic representations of a further preferred embodiment of a printing press system.

In addition to the above-described X-configuration, a configuration, as is represented in FIG. 22, can also be advantageous. Only in one of the two printing presses 01; 31, which are positioned orthogonally in relation to one another in terms of their machine alignments M1; M2, are the printing units 02; 03 and the former assembly 07; 17, which is assigned in straight-line travel, arranged on different sides of the machine alignment M1; M2 of the other printing press 01; 31. The webs 11; 21, which are running in straight-line travel in stand-alone production, do not intersect here in their respective paths to the former assembly 07; 17. In this orthogonal arrangement of a first machine line and of a second machine line 30; 25, respectively, and/or of printing press 01; 31, the printing units 03; 02, of, for example, the second machine alignment M2; M1, and the former assembly 17; 07 for this machine alignment M2; M1, assigned in straight-line travel, are on two different sides of the machine alignment M1; M2 of the first printing press 01; 31 or on the same side of the turning device 10 that can be assigned to the two printing presses 01; 31. The printing units 02; 03 of the first machine alignment M1; M2 and the former assembly 07; 17 for this machine alignment M1; M2, which is assigned in straight-line travel, are on the same side of the machine alignment M2; M1 of the second printing press 31; 01 or the same side of the turning device 10, which can be assigned to the two printing presses 31; 01. Because the printing presses 01; 31, with their respective printing units 02; 03 and with their respective former assemblies 07; 17, are arranged in a T-shape relative to one another, from a top plan view, this configuration will also be referred to, in what follows, as a T-configuration.

In the T-configuration, as shown, for example, in FIG. 22, and preferably in the area of the point of intersection of the two machine alignments M1; M2, the turning device, or a plurality of such turning devices 10, and a guide roller, or a group of guide rollers 13, are configured such that at least one web 21 or a partial web can be optionally fed, via these guide rollers 13 and/or turning devices 10, from the one machine line 25, or the printing press 31, in a straight line, to the assigned former assembly 17, or can be turned 90°, via one or more turning bars 32 of the turning device 10, to the former assembly 07 of the other machine line 30 or to the printing press 01.

In addition, turning bars 32 in the turning devices 10, or a second turning device 10, and a guide roller or a group of guide rollers 20 can also be provided such that, through these guide rollers 20 and/or turning devices 10, one or more webs 11 from the first machine line 30 or the first printing press 01 can be optionally turned 90° and can be fed to the former assembly 17 of the second machine line 25 or printing press 31, rather than being fed to the former assembly 07 which is assigned in straight-line travel. Thus, webs 11; 21 from the machine lines 30 and 25 can again be combined on a former assembly 07; 17 to form a hybrid product.

In the preferred embodiment of FIG. 22, the first printing press 01 has a plurality of printing units 02 of the first type, in this case four such printing units 02, and has at least one former assembly 07, and in this case two such former assemblies, in the machine alignment M1. In the view a) of FIG. 22, the printing press system is represented from a side of the first printing press 01. In view b of FIG. 22 a side of the second printing press 31 is shown. In view c) of FIG. 22, a view is shown from a plan view. In view d) a schematic front view of the former assembly 07 of the first printing press 01 is shown. The printing units 02 of the first type are configured here as printing towers 02, and can represent stacked bridge printing units, stacked satellite printing units or stacked H-printing units.

Roll changers 12, for use in supplying the printing units 02 with the webs 11, which webs 11 are not shown in FIG. 22, are provided for the printing units 02, for example, in a plane located below the plane that contains the printing units 02. In one production mode, all the webs 11 which are to be printed in the printing units 02 can be fed, in straight-line travel, via a superstructure 39 that is assigned to this printing press 01, to the, in this case double-width, former assembly 07. The printing units 02 of the first printing press 01 are, for example, double width, and are advantageously configured as coldset printing units 02. They can be structured as single circumference or as double circumference, based upon one newspaper page.

The printing units 03 of the second printing press 31 are situated laterally, as discussed above, to the side of the machine alignment M1 of the first printing press, and orthogonally thereto. A roll changer 26 for supplying the printing units 03 with the webs 21 is also provided for the printing unit 03 and is situated, for example, in a plane below the plane that contains the printing units 03. The printing unit(s) 03 of the second printing press 31 are, for example, single-width in structure and can be advantageously configured as heatset printing units 03. In this case, a dryer 15, such as, for example, a hot air dryer, a UV dryer or an IR dryer, is provided in the web path. The printing units 03 of the second type can also be single circumference or double circumference in structure, based upon a newspaper page. In principle, the two printing presses 01; 31 and/or their printing units 02; 03 can differ in multiple ways as described above, with respect to process, substrate, ink type, and/or printing cylinder size.

In the area in which the two machine alignments M1; M2 intersect, the turning device 10 with at least one turning bar 32 is arranged such that in hybrid production, the direction of transport T2 of the web 21 can be brought 90° into the alignment of a partial web 11.1; 11.2, or into the alignment of a fold former 09 of the first printing press 01. Preferably, in hybrid production, the direction of transport T1 of a partial web 11.1; 11.2 can also optionally be brought 900 into the alignment of the web 21 or of the fold former 19 of the second printing press 31, via the turning device 10. The turning bar 32 is preferably structured so as to be movable in a direction along the machine alignment M2, all as seen in FIG. 22. In this way, an alignment in the first printing press 01, with respect to the run-up to one or more fold formers 09; 09', can be varied. In stand-alone production, the web 21 from the printing unit 03 of the second type, the "second printing unit" can be fed in straight-line travel to the former assembly 17, and into the folder 18 that is situated downstream from former assembly 17, and the webs 11, which are not specifically shown in FIG. 22, can be fed in straight-line travel to the former assembly 17 and into the folder 18 that is located downstream from this. Regarding the components of the individual units, such as the printing units 02; 03, the former assemblies 07; 17, the turning device 10 and/or the folders 08; 18, what has been specified in relation to the previously discussed preferred embodiments is to be applied, where appropriate and possible.

Figure 27:
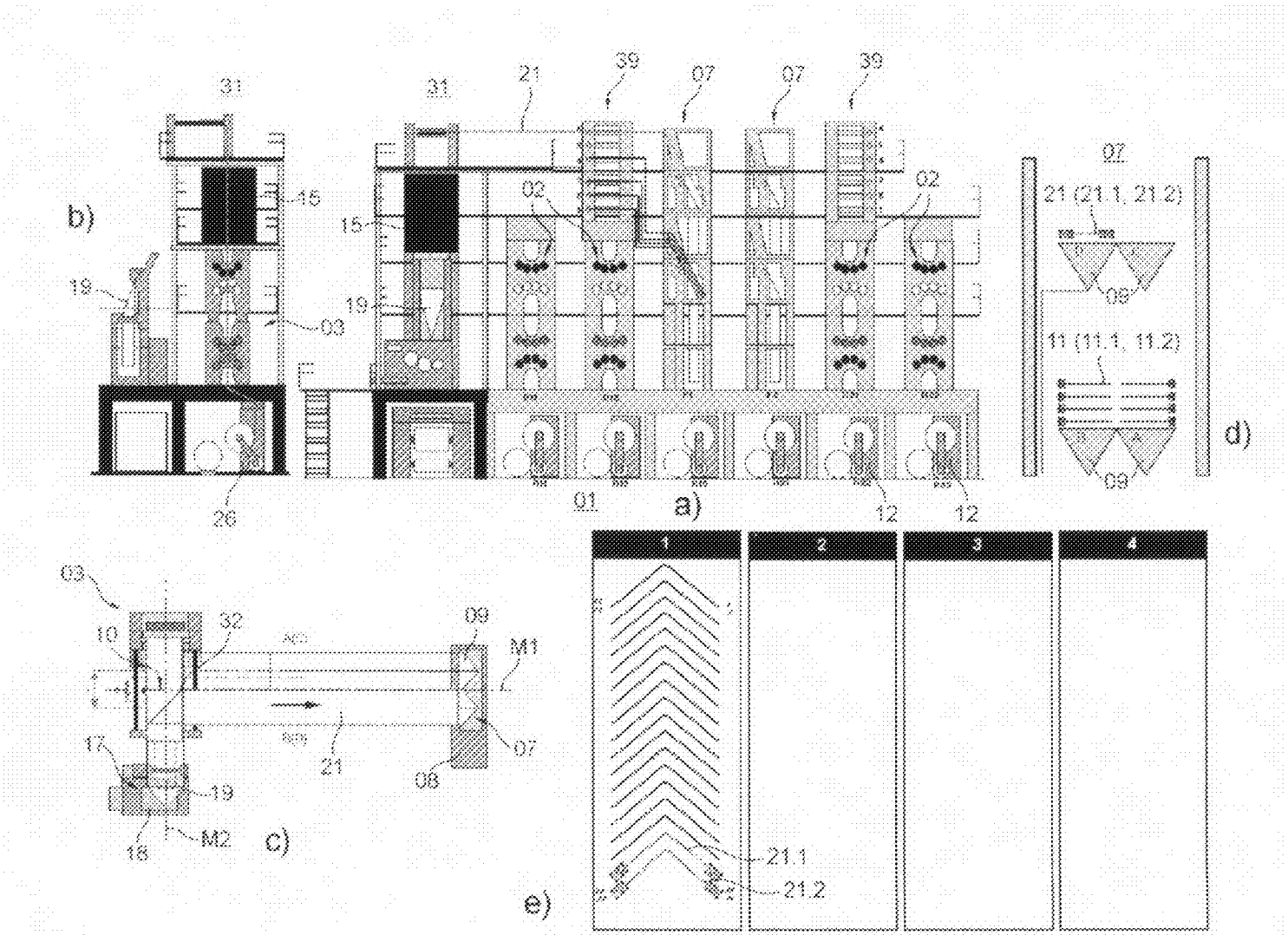
FIG. 27*a*), *b*), *c*), *d*) and *e*) schematic representations of a preferred embodiment of a production and/or web lead for the printing press system of FIG. 22.
Figure 28:
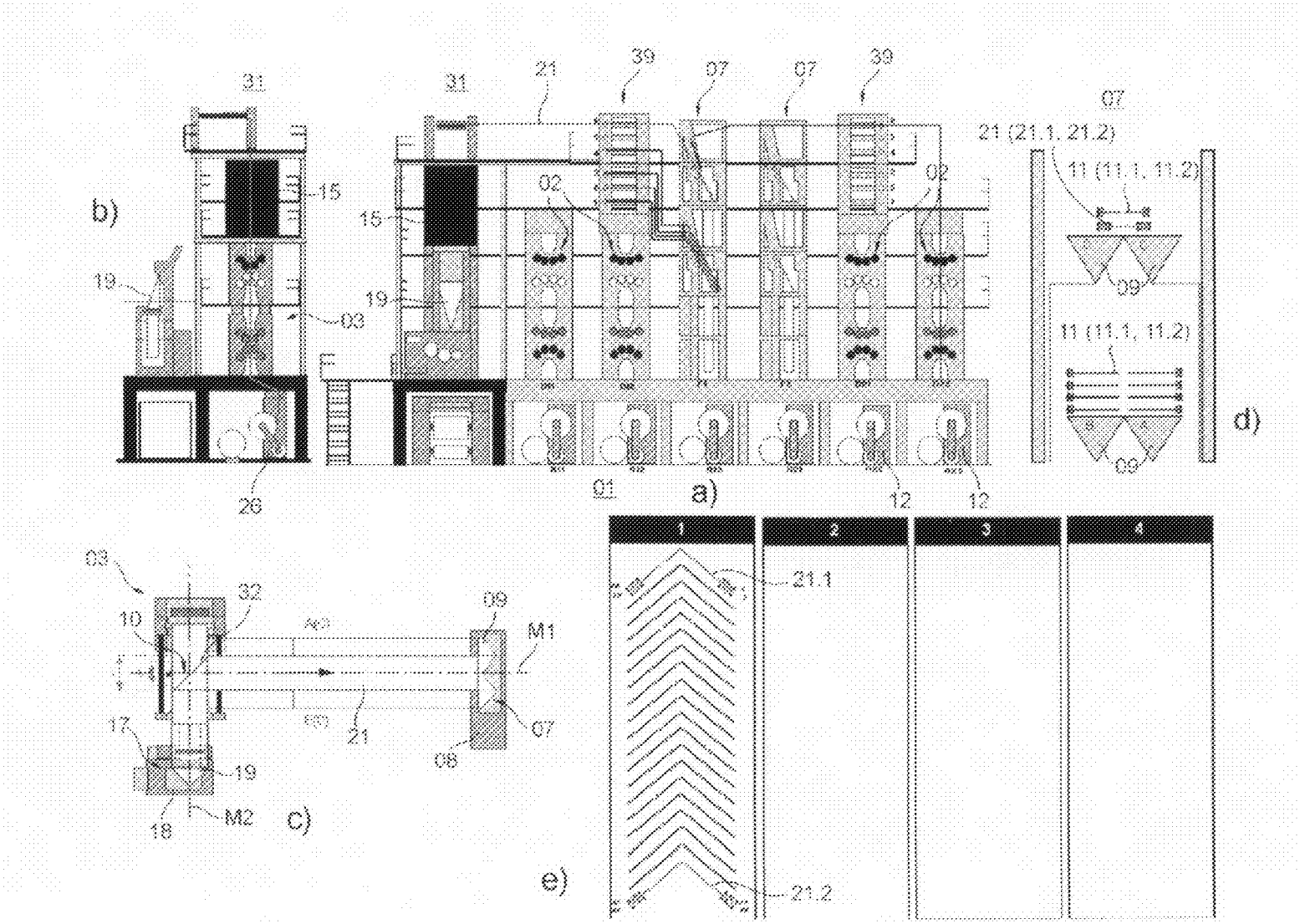
FIG. 28*a*), *b*), *c*), *d*) and *e*) schematic representations of a preferred embodiment of a production and/or web lead for the printing press system of FIG. 22.
Figure 29:
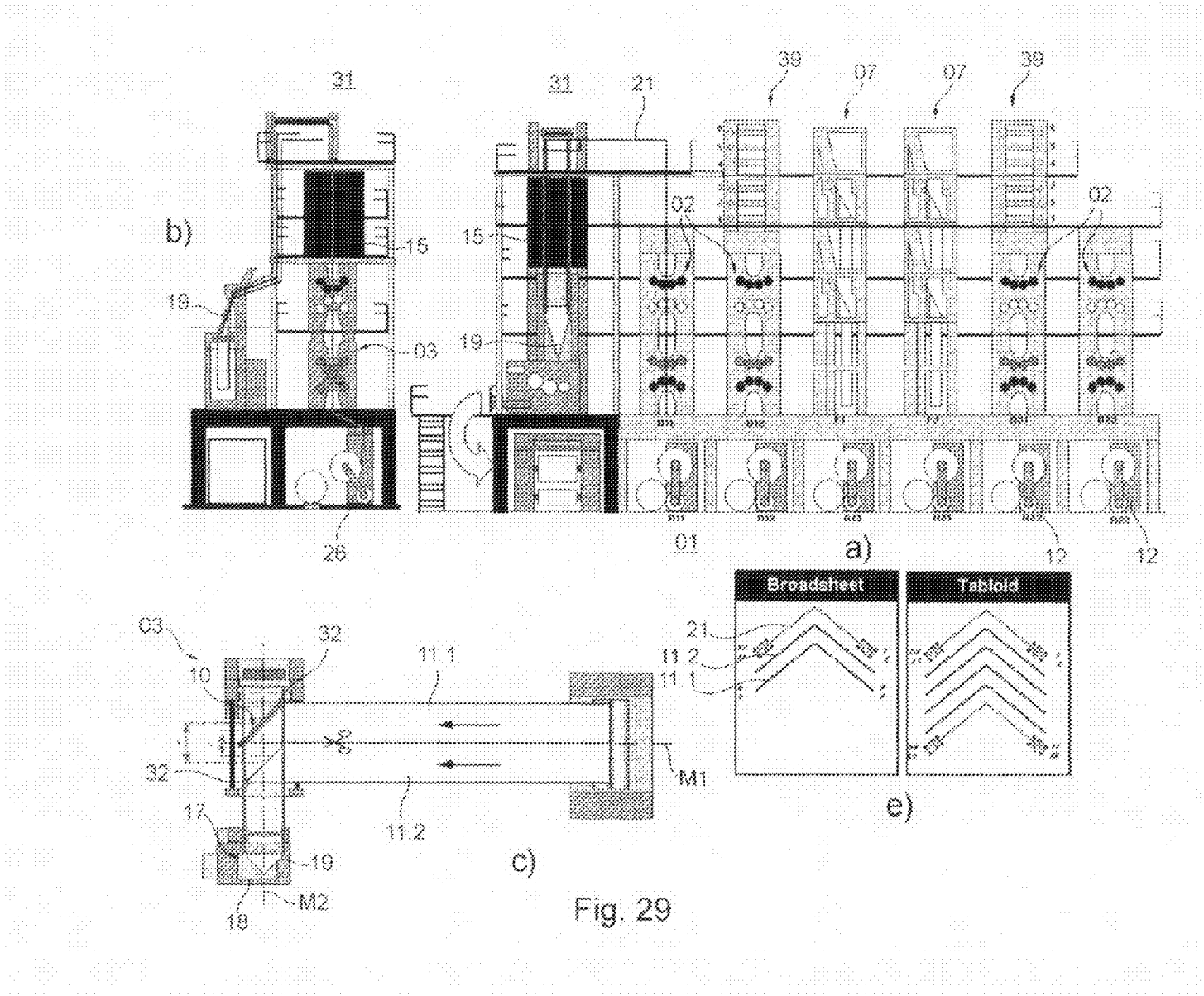
FIG. 29*a*), *b*), *c*) and *e*) schematic representations of a preferred embodiment of a production and/or web lead for the printing press system of FIG. 22.

In FIG. 23 through 29, practical examples of possible production processes, or of possible web leads for the printing press system of FIG. 22 are schematically represented. In these examples, in views a) through d), the perspectives from FIG. 22 have been chosen, however, view c) of FIGS. 23 through 29 has been reduced to the web lead between the former assemblies 07; 17. View e) in FIG. 23 through 28, which is not present in FIG. 22, shows the sections of a product formed with this production process when the webs 11; 21 or the partial webs 11.1; 11.2; 21.1; 21.2 are opened up in the manner of a tabloid product along the fold line to be formed or which has been formed by the fold former 09; 09', and the ribbons have been guided one on top of one another after passing through the former assembly 07. FIG. 29, in view e), shows the series of tabloid sections opened up along the fold line, and further shows a series of sections in double-sided broadsheet format and left as double pages.

Figure 23:
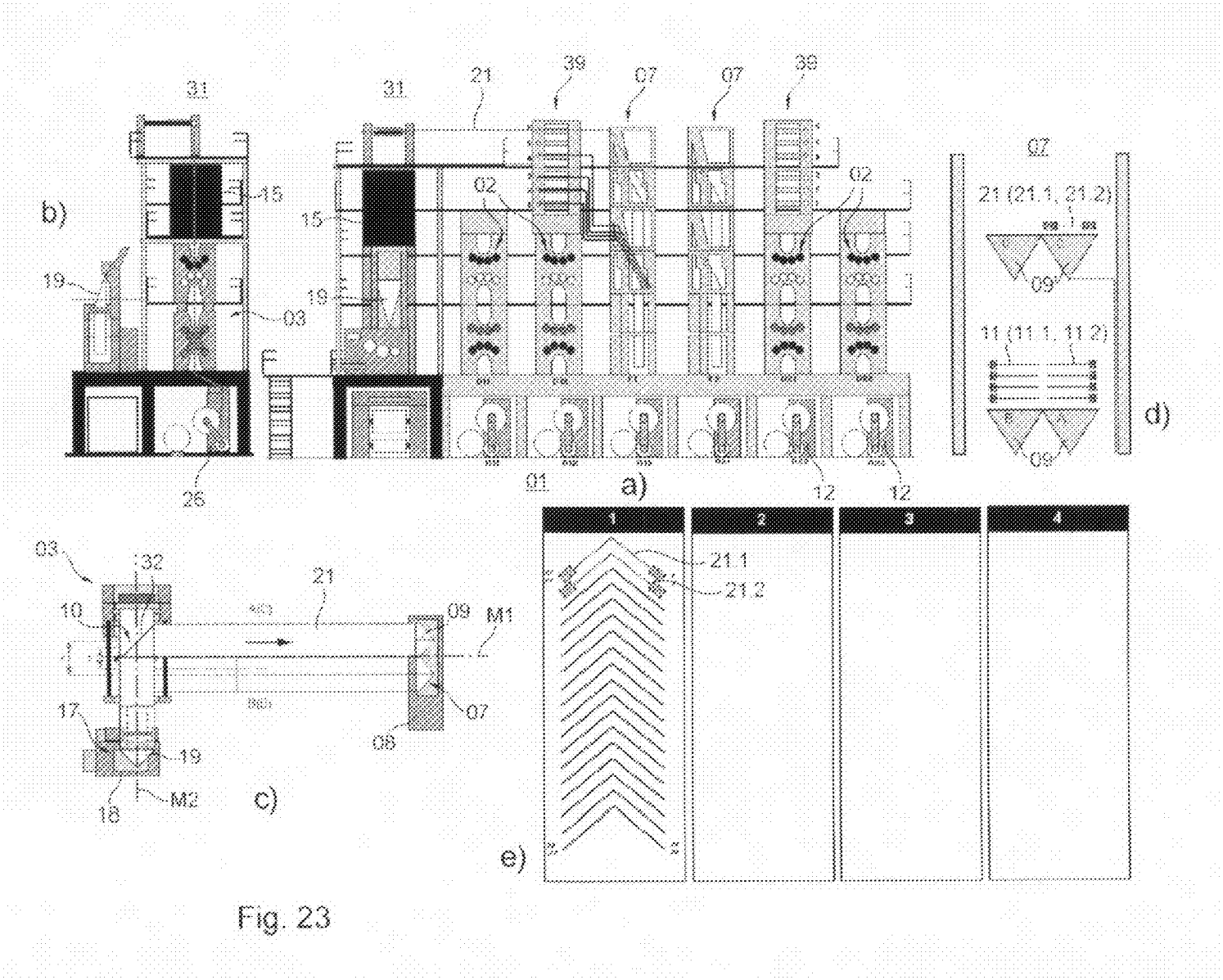
FIG. 23*a*), *b*), *c*), *d*) and *e*) schematic representations of a preferred embodiment of a production and/or web lead for the printing press system of FIG. 22.

In FIG. 23, the web 21 emerging from the printing unit 03 of the second type, such as, for example, a heatset printing unit 03, is turned on the turning bar 32 of the turning device 10, out of the machine alignment M2 and into an alignment that is parallel with the machine alignment M1. The turn is made at the level of the first of two adjacent fold formers 09; 09' in a former group, characterized here as the alignment A(C). In the depicted example of FIG. 23, the web 21, or single-page-width partial webs 21.1; 21.2 is or are guided to the upper fold former 09', which is identified as "C". Here, the webs 11, or the partial webs 11.1; 11.2, printed in the printing units 02 of the first type, such as, coldset printing units 02, are fed to the two lower fold formers 09 "B" and 09 "A". Feeding the web 21 to the designated fold former 09 "C", and diverting the formed ribbon around the lower fold formers, cause the sections of the web 21 to be situated on the outside of the product, in this case at the top, as seen in view e) of FIG. 23.

Figure 24:
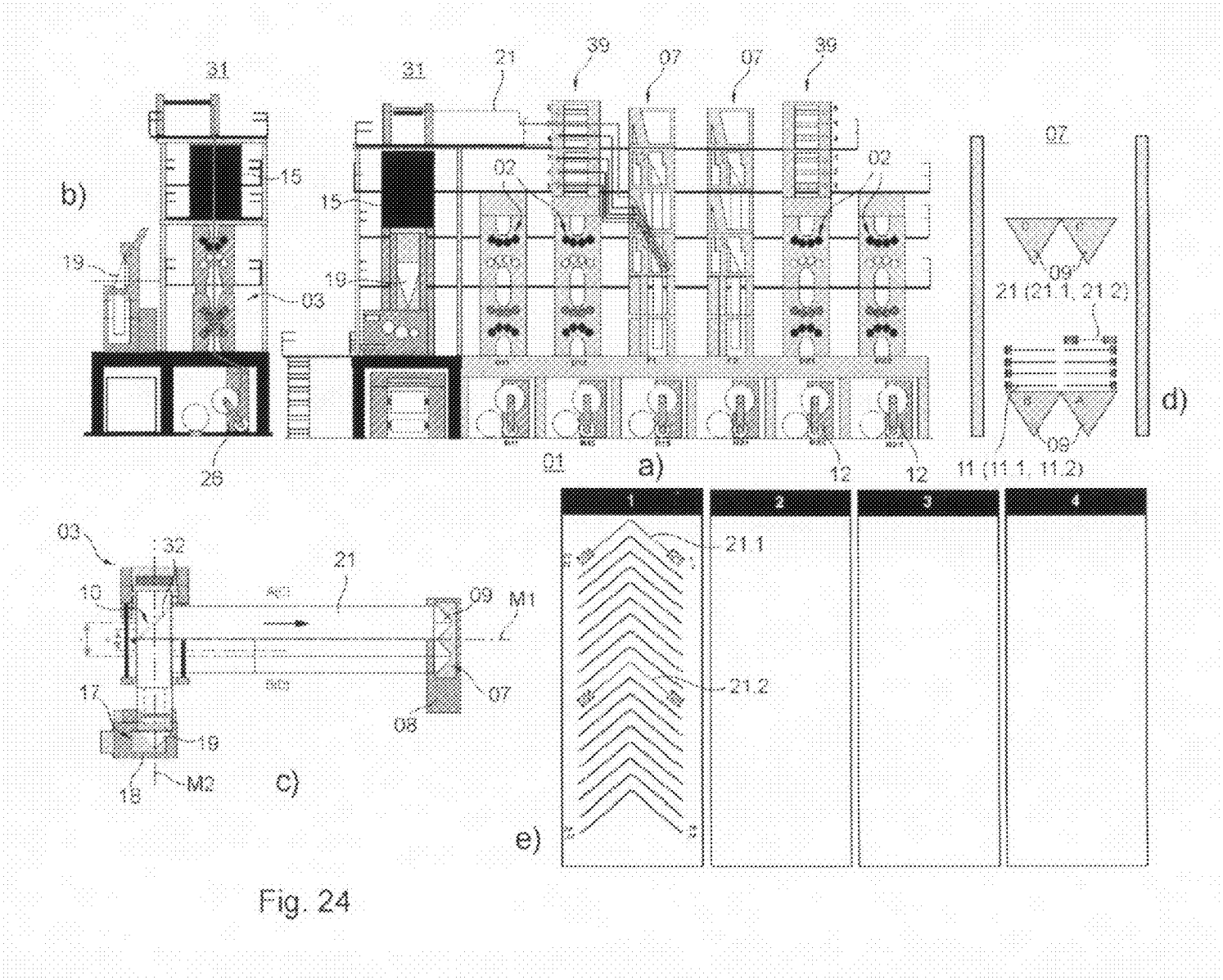
FIG. 24*a*), *b*), *c*), *d*) and *e*) schematic representations of a preferred embodiment of a production and/or web lead for the printing press system of FIG. 22.

In the subsequent FIGS. 24 through 28, additional examples of production processes or of web leads are presented. The web 21 from the printing unit 03 of the second type is brought into the alignment of the first printing press 01 and a hybrid production is performed, using the former assembly 07 of the printing press 01 of the first type. In FIG. 24, the web 21 is led in the same alignment A(C), but to a lower fold former 09. The one of the two partial webs 21.2; 21.1, which were printed in the printing unit 03 of the second type, then lies between the sections, that were printed by the printing units 02 of the first type, in the overall product.

Figure 25:
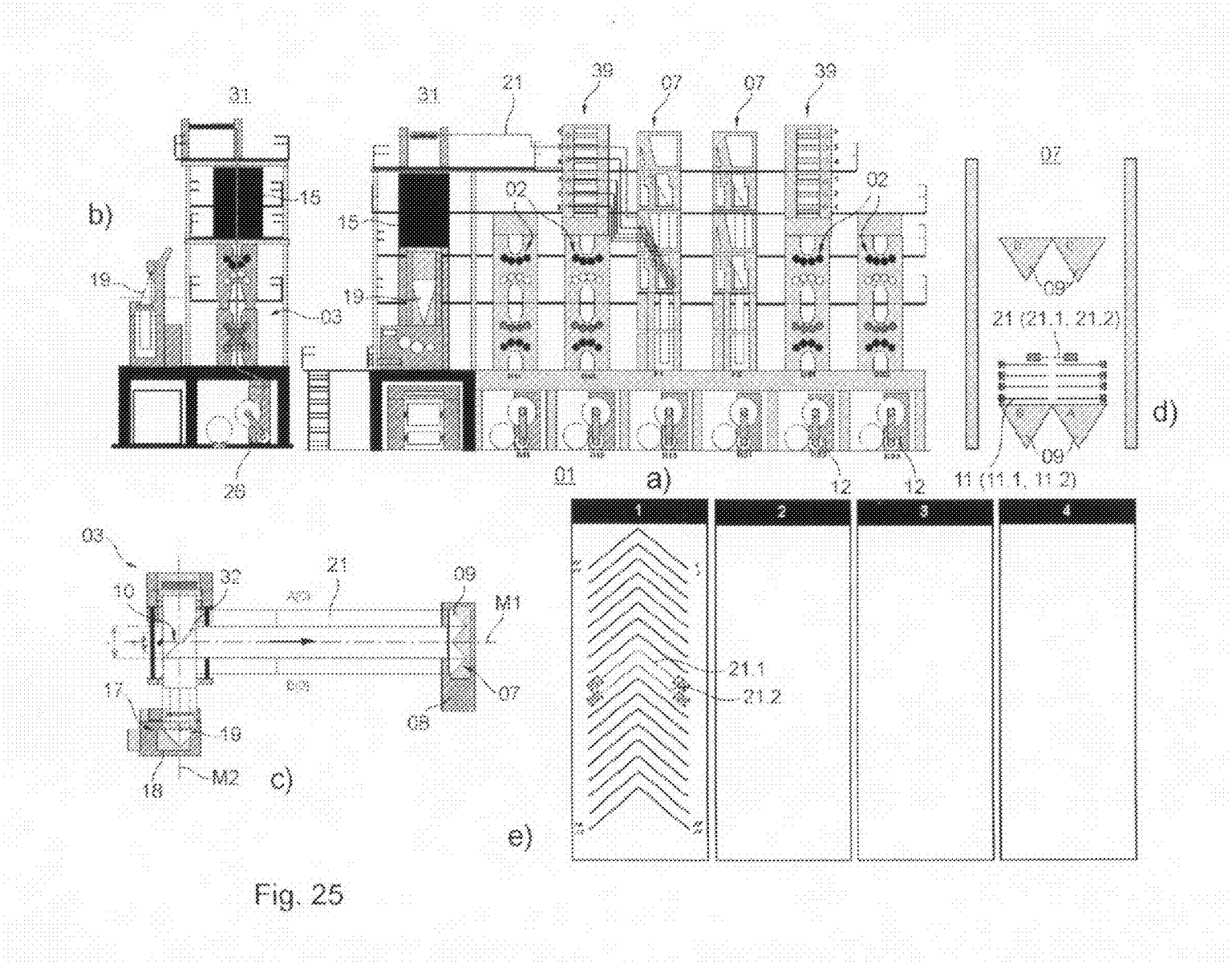
FIG. 25*a*), *b*), *c*), *d*) and *e*) schematic representations of a preferred embodiment of a production and/or web lead for the printing press system of FIG. 22.

In FIG. 25, the web 21 is brought into an alignment precisely between two adjacent fold formers 09; 09', and is cut lengthwise at the center, so that one half runs up to a fold former 09; 09' and the other half runs up to the adjacent fold former 09'; 09. The two partial webs 21.1; 21.2, which have been printed in the printing unit 03 or in the printing press 31 of the second type, then lie between the partial web sections which have been printed by the printing units 02 of the first type in the overall product.

Figure 26:
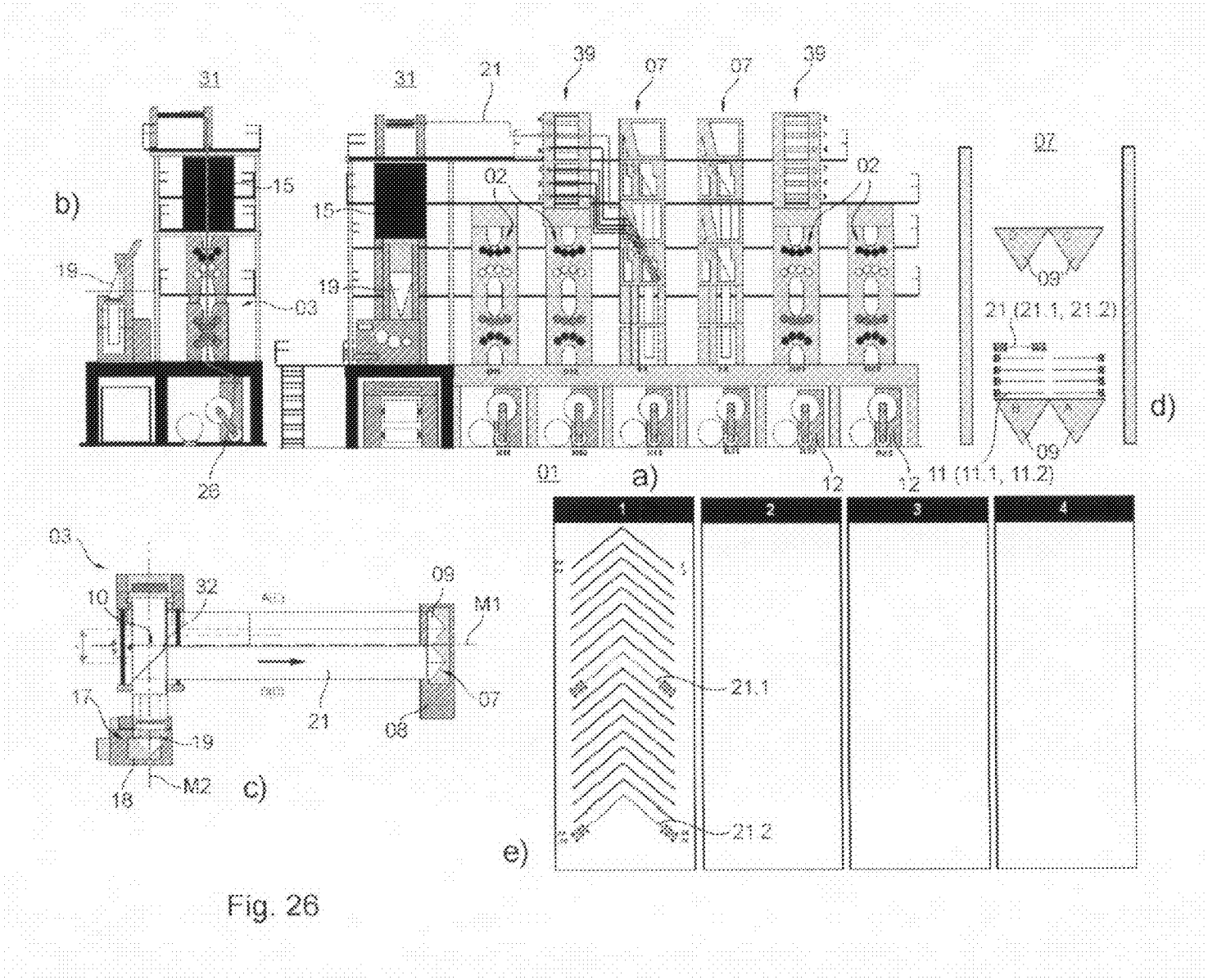
FIG. 26*a*), *b*), *c*), *d*), and *e* schematic representations of a preferred embodiment of a production and/or web lead for the printing press system of FIG. 22.

In FIG. 26, the turning bar 32 is brought to a position in which the web 21 is brought to the alignment B(D) of the other of two adjacent fold formers 09; 09', as compared with the orientation or assignment which is depicted in FIG. 23. One section of the partial webs 21.1; 21.2, that are coming from the printing unit 03 of the first type, then lies between the sections printed by the printing units 02 of the first type, and one section of the partial webs 21.1; 21.2 lies at the center.

In FIG. 27, the web 21, which is comparable with the similar depiction in FIG. 23, is fed to a designated fold former 09', and the partial webs 21.1; 21.2, that are formed by a longitudinal cut, are brought together again, and are fed toward the outside past the lower fold formers 09. Both of these sections then lie at the center of the overall product.

In FIG. 28, the web 21 from the second printing unit 03, and a web 11 from the first printing units 02 are cut lengthwise and are guided to the upper group of fold formers 09' such that one web half runs up to one fold former and the other web half runs up to the adjacent fold former. The two ribbons that are formed are fed on different sides around the group of lower fold formers 09, and are then combined again with their ribbons. One of the partial webs 21.1; 21.2 that have been printed in the "second" printing unit 03 then lies at the center of the overall product, and the other partial web lies on the outside of the overall product.

In FIG. 29, an operational situation is presented in which a web 11 or a partial web or webs 11.1; 11.2 coming from the first printing press 01 and/or a printing unit 02 of the first type is or are turned into the machine alignment M2 of the second printing press 31 or of a web 21 that is passing through the second printing press 31 in straight-line travel. Hybrid production is performed on the former assembly 17, which, in this case is of single width, which former assembly 17 is assigned to the second printing unit 03 in straight-line travel. In the configuration of the printing press system, in which partial webs 11.1; 11.2 from a wider, such as, for example, multiple-width, printing unit 02, are to be turned into the machine alignment M2 of a narrower, for example, single-width printing press 31, a plurality of turning bars 32 are advantageously provided in the turning device 10. This also applies to other previously described combinations of printing presses 01; 31 of different widths.

In the example depicted in FIG. 29, the double-width web 11 is cut lengthwise, and the partial webs 11.1; 11.2 are brought, via the two turning bars 32 of the turning device 10, into the alignment of the web 21 that has been printed by the printing unit 03 of the second type. These are fed, together with the web 21 or the partial webs 21.1; 21.2 from the printing unit 03, over the former assembly 17. If the sections, which are fed one above another, are not opened up in the area of the fold line, the broadsheet product, which is shown on the left in view e) of FIG. 29 results when the partial webs 11.1; 11.2 from the first printing press 01 are turned in below the web 21 from the second printing press 31. With this arrangement, the web 21 from the second printing unit 03 lies on the outside. If the partial webs 11.1; 11.2 had been turned in above the web 21, the latter would lie on the inside. However, if the sections, led one above another, are opened up in the area of the fold line, the tabloid product, which is represented on the right in view e) of FIG. 29, results when the partial webs 11.1; 11.2 from the first printing press 01 are turned in below the web 21 from the second printing press 31. In this manner, one of the partial webs 21.1; 21.2 from the second printing unit 03 lies on the outside of the overall product and one of the partial webs 21.1, 21.2 lies at the center of the overall product. If the partial webs 11.1; 11.2 had been turned in above the web 21, the sections of the partial webs 21.1; 21.2 from the second printing press 31 would lie between the sections of the partial webs 11.1; 11.2 from the first printing press 01.

Figure 30:
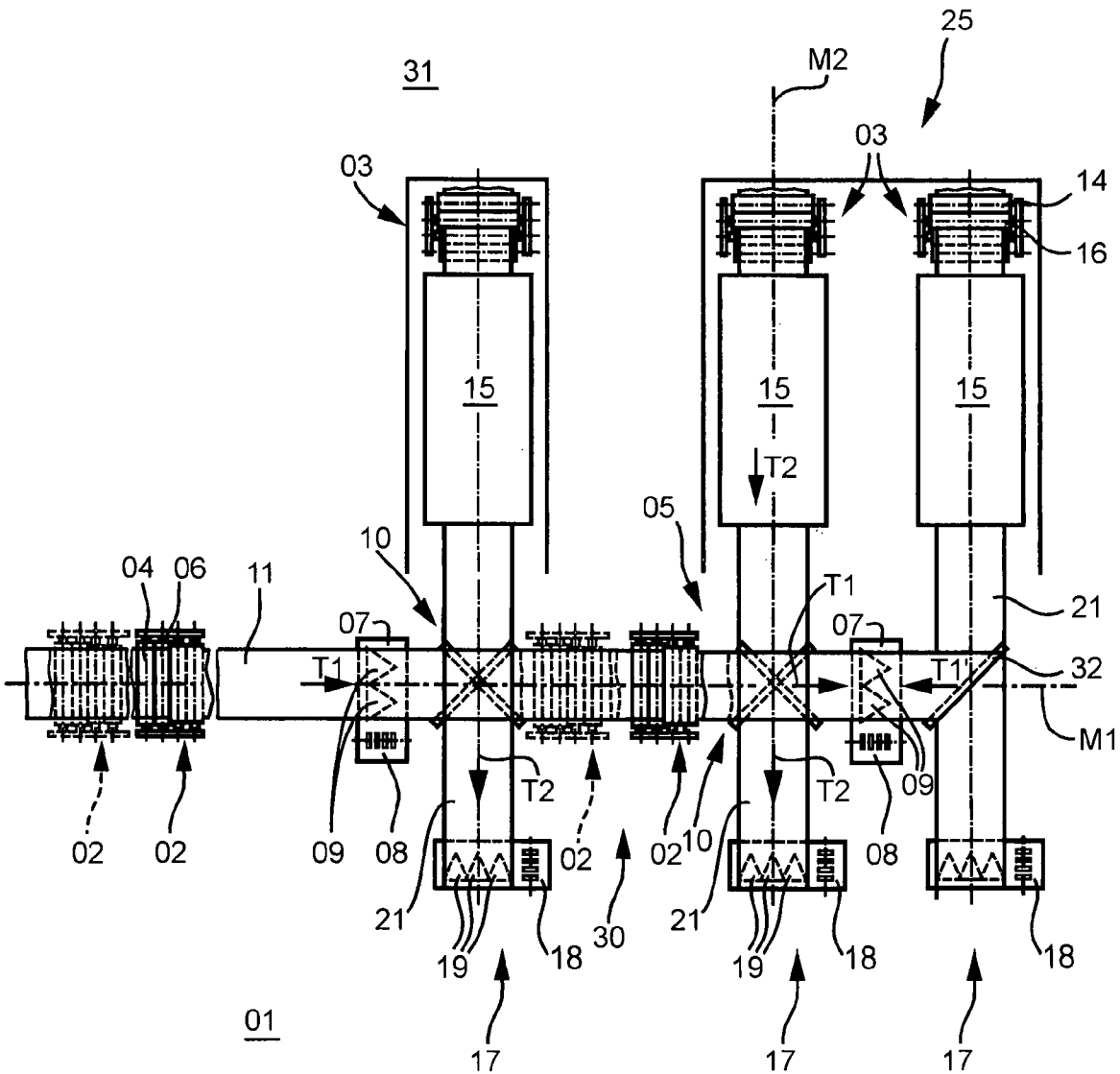
FIG. 30 a schematic top plan view of a further preferred embodiment of a printing press system comprising a plurality of printing units.

FIG. 30 shows a further example of a printing press system in an X-configuration in accordance with the present invention. A plurality of printing units 02 of the first type, such as, "dedicated" coldset printing units 02, and/or at least one coldset printing unit 02 and a former assembly 07 and optionally an additional dedicated turning device for the first printing press 01 are again arranged in the manner of a so-called linear machine 01, for example, in a shared machine alignment M1, which shared machine alignment M1 is oriented perpendicular to the axial direction of its printing group cylinders 04; 06. A folder 08, such as, for example, a coldset folder 08, is again arranged downstream from the former assembly 07. One or more fold formers 09 of the former assembly 07 are oriented, as discussed previously, such that the webs 11, which are running up to the fold formers 09, have a direction of transport T1; T1', which is projected into the horizontal plane and which extends along, or parallel to, the machine alignment M1. In other words, the webs 11 that have been printed in the coldset printing units 02 can be fed to the fold formers 09 in so-called straight-line travel.

The printing units 02 of the first printing press 01 are configured, for example, as printing towers 02, each of which printing towers preferably has two stacked H-printing units. In principle, the printing towers 02 can also have two stacked satellite printing units or can have four blanket-to-blanket printing groups for use in double-sided printing.

In the present example depicted in FIG. 30, the printing press 01, which is configured as a linear machine 01, has a plurality of former assemblies 07, in this case two such former assemblies 07, in the machine alignment M1, each with one folder 08 located downstream from it and with at least one assigned printing unit 02 of the second type. A former assembly 07, with an assigned printing unit 02 or with assigned printing units 02, can be characterized as a section. The assignment of a printing unit 02, which is arranged especially between two former assemblies 07, can be varied between one and the other section. In this case, the printing unit 02 is assigned to the section on whose former assembly it is implementing production.

Roll changers 12, which are not specifically shown in FIG. 30, for use in supplying the printing units 02 with the webs 11, are provided for the printing units 02. They are typically situated in a plane that is below the plane that contains the printing units 02.

Furthermore, preferably in the web path between the printing unit 02 and the assigned former assembly 07, units of a so-called superstructure 05, such as, for example, a group of guide rollers 13, or a guide roller group 13, which are not specifically shown, can be provided, over which superstructure 05 the printed webs 11 can be fed, thereby allowing the sequence of the sections to be established on the fold former 09. If applicable, the superstructure 05 can also have additional units, such as, for example, a longitudinal cutting device and/or an additional turning devices for partial-width webs, and which are assigned to the first printing press.

As can be seen in FIG. 30, the former assembly 07, especially in the case of multiple-width webs 11, such as, four or even six newspaper pages wide, can have two fold formers 09 arranged side by side in one plane, with each such fold former being wide enough for folding webs 11 or partial webs 11.1; 11.2 that are two newspaper pages in width. However, more than two, and for example, three fold formers 09, especially in the case of a triple-width web 11, can also be arranged side by side in a single plane. As was described in reference to previous embodiments, two of these groups and/or pairs or groups of three fold formers 09 can be arranged one above another in two planes, for example, in a balloon former arrangement.

In the embodiment represented in FIG. 30, the printing unit 02 is configured for printing webs 11 that are the width of four vertical newspaper pages arranged side by side, especially in broadsheet format, or for printing four horizontal tabloid pages of a first tabloid format, such as, double width. In this case, a longitudinal cutting device, which is not specifically shown, is provided in the web path between printing unit 02 and former assembly 07, and is configured to cut the double-width web 11 into two partial webs 11.1; 11.2.

Webs 11, which are to be printed in the first printing press 01 that is preferably configured as a newspaper printing press 01, are then, for example, rolled off of the roll changer 12, which is not specifically shown here, are fed through the printing unit 02, where they are printed in a single or multicolor process, are then fed via one of the guide rollers in the guide roller group 13 to the former assembly 07, are folded lengthwise on a fold former 09 and are fed to the folder 08 for further processing. In the case of multiple-width webs 11, with a width of, for example, four or even six newspaper pages wide, these webs can be cut into partial-width webs, either directly in front of a turning device, which is not specifically shown, for the first printing press 01, such as, a turning deck, or immediately before reaching the fold former 09, by the use of a longitudinal cutting device, which also is not specifically shown. Viewed alone, the printing press 01 which is configured in this way, is therefore fully equipped having been provided with printing units 02, if applicable with a turning device, with a former assembly 07 and with a folder 08, and thus can be operated independently of another. It is equipped for the printing and, if applicable, for the further processing of the product to be chiefly produced with this printing press 01, using the units required for this purpose, such as, for example, corresponding printing units 02 and/or former assemblies 07 and/or folders 08.

At least one printing unit 03 or one machine line 25 or printing press 31 of a second type is again arranged to the side of the machine alignment M1 of the first printing press 01. The printing units 02; 03 of the first and second type are orthogonal to one another, as discussed above. In other words, the machine alignment M2 and/or the direction of passage through the dryer 15 is, for example, essentially perpendicular to the machine alignment M1. A plurality of printing units 03 or of machine lines 25 of the second type can also be assigned to the first printing press 01, and can be offset laterally, as shown in FIG. 30. These can then be arranged side by side, as shown, and spaced axially along the printing group cylinders 14; 16. In an embodiment that is not shown here, however, a plurality of second printing units 03, such as ones which are similar to the linear arrangement of the printing press 01, can also be arranged one in front of another along a machine alignment M2. The heatset printing unit 03 and the assigned dryer 15 are therefore arranged transversely to the printing press 01.

The forme cylinder 14 of the heatset printing unit 03 preferably has an effective cylinder width, and is thus usable for printing a web 21, which effective cylinder width corresponds to at least four newspaper pages of the format to be printed on the first printing press 01, such as, for example, newspaper printing press 01.

At least one former assembly 17, with at least one fold former 19 and with one folder 18 arranged downstream from this, such as, for example, a heatset folder 18, and with the at least one former assembly 17 being different from the former assemblies 07 of the printing press 01, is assigned to one or more of the heatset printing units 03 or the heatset machine lines 25.

As has already been described in reference to previous preferred embodiments, the two machine lines 30; 25 that are perpendicular to one another, are both configured as printing presses 01; 31 for the straight-line travel of printed webs 11; 21. In other words, the former assemblies 07; 17 are preferably oriented such that material webs 11; 21 running up to the fold formers 09; 19 each have a direction of transport T1; T1'; T2, which is projected into the horizontal plane and which extends along, or parallel to, the machine alignment M1; M2 of the respective machine line 30; 25. In other words, the webs 11, that have been printed in the printing units 02, and the webs 21, that have been printed in the printing units 03, can be fed to their assigned fold formers 09; 19 in so-called straight-line travel in one operating mode.

In this configuration of the two printing units 02; 03 and/or of the two printing presses 01; 31 and/or of the two machine lines 30; 25 arranged perpendicular to one another, it is then provided that, as shown, for example, in FIG. 1, the former assembly 07, which is assigned to the one printing unit 02 or printing press 01, is arranged in the machine alignment M1 for the straight-line travel of webs 11 that have been printed in this printing press 01. The former assembly 17 which is assigned to the other printing unit 03 or printing press 31, and which is oriented perpendicular to the former, is arranged in the machine alignment M2 for the straight-line travel of webs 21 printed in this machine line 25. In a "normal" print operation, such as, one in which webs 11; 21 from the two different printing units need not be combined, production can then be performed on the respectively assigned former assembly 07; 17 in straight-line travel. The former assemblies 07; 17 are then also situated orthogonally to one another, with respect to the direction of transport T1; T1'; T2 of a web 11; 21 that is running up to them.

In this orthogonal or crossed configuration, or X-configuration, of the first and the second machine lines 30; 25, the printing unit 03 and the former assembly 17 for the second machine line 25, which are assigned in straight-line travel, are situated on different sides of the machine alignment M1 of the first machine line 30, as viewed in a horizontal projection and as seen in FIG. 30. The two machine lines 30; 25 are then, for example, arranged, in relation to one another, such that two webs 11; 21, which are printed in the two crossed printing presses 01; 31, intersect at a right angle on their respective paths between the printing unit 02; 03 and the respective fold former 09; 19 that is assigned to each such printing unit 02; 03, in straight-line travel, as viewed in a horizontal projection. Preferably, in the area of this point of intersection of the two straight-line web leads, the above-described superstructure 05 is configured with one or more turning devices 10 and with a group of guide rollers 13 such that, through the use of these guide rollers 13, at least one web 21 or at least one partial web 21.1; 21.2 from the one machine line 25 can optionally be fed in a straight line to the assigned former assembly 17, or can optionally be turned 90° and can be fed to the former assembly 07 of the other machine line 30. Additionally, turning devices 13 can be provided, with which one or more webs 11 from the one machine line 25, rather than being fed in only a straight line to the assigned former assembly 07, can optionally be turned 90° and fed to the former assembly 17 of the other machine line 30. Thus, webs 11; 21 from the machine lines 30 and 25 can be combined on a former assembly 07; 17 to form a hybrid product.

In one advantageous embodiment, the heatset former assembly 17 has at least two, and preferably has three fold formers 19, which are arranged side by side in the same machine plane. The latter applies, for example, in connection with webs that are triple-width with regard to a certain print page format. The fold formers 19 each have, for example, a width that measures less than half of a maximum web width to be processed in the printing unit 03 and/or the total widths of which equal the maximum web width. The width of each fold former 19 corresponds, for example, essentially to one-third of the maximum web width of a triple-width web 21 to be processed in the second printing press 31. The maximum web width to be processed can be, for example, 54". The outer two of the three fold formers 19 are preferably both configured to be movable transversely to the direction of transport T3; T3' of the entering web 21. The center fold former 19 can be fixed in place in a transverse direction. The three fold formers 19 can be arranged offset from one another in a vertical direction such that they nevertheless intersect, when viewed in a horizontal direction, as discussed below. Thus, although the three fold formers 19, in terms of their operations engineering, are situated within a shared machine plane, they can nevertheless be shifted laterally, in relation to one another, without impeding one another. This is advantageous when different web widths are to be processed. The above-mentioned folder 18 is arranged downstream from the former assembly 17, and, in addition to the fold formers 19 that form a longitudinal fold, has, for example, a further, second longitudinal folding unit for use in forming a second longitudinal fold.

A web 21 that has been printed in the machine line 25, in either heatset or in coldset operation, can, for example, be rolled off of a roll changer 26, which is not specifically shown here, and can be fed through the printing unit 03, where it is printed in a single- or a multicolor process. Web 21 is then fed, in heatset operation, through the activated dryer 15, such as a hot air, a UV or an IR dryer, and, if applicable, is then fed through a cooling device, which is typically located downstream, or, in coldset operation, is fed through the deactivated dryer 15 or around that dryer in straight-line travel to the former assembly 17, is folded lengthwise over a fold former 19, and is fed to the folder 18 for further processing. In the case of multiple-width webs 21, such as, for example, of four or six print pages wide, these webs 21 can be cut into partial-width webs, either directly in front of the turning device 22, or directly before each web reaches the fold former 19, by the use of the longitudinal cutting device, not shown, and if applicable can optionally be laterally offset via a turning device that is assigned to the second printing press 31, and which is not specifically shown here. The heatset machine line 25, along with an optionally provided dedicated turning device, the former assembly 17 and the folder 18, therefore forms a separate, fully equipped second printing press 31, such as, for example, a separate telephone book or magazine printing press 31. It can be operated independently from the first printing press 01, and it is, for example, equipped for printing and, if necessary, for further processing the product that is to be chiefly produced with this printing press 31, using the units required for this, such as, for example, the respectively corresponding printing units 03 and/or the former assemblies 17 and/or the folders 18.

In a first production situation for the printing press 31 of the first type, for example, the heatset printing press 31, a magazine, telephone book, or catalog production process can, for example, be performed using this machine in pure heatset operation, and with webs 21 that are six pages wide, based upon this print page format, on the three fold formers 19. The printing formes 29 on the forme cylinders 14 are then equipped, as discussed previously, with the six print images of this format, which are located side by side.

In another production situation, the forme cylinders 14 of the second printing unit 03 can also optionally be loaded with one or more printing formes 28, which printing formes 28 bear print images in a newspaper format, and especially in the newspaper format to be printed in the first printing press 01, or print images in the tabloid format to be printed in the first printing press 01. For example, four print pages of the corresponding format can be arranged side by side. Preferably, this production situation for the machine line 25 of the second type can occur optionally in heatset or in coldset operation, taking into account the corresponding ink and/or the corresponding paper and/or the activity or the web path with respect to the dryer 15, as has been discussed above.

To enable a combined production process, and specifically a so-called hybrid production process, as in the above-mentioned examples, at least one web 21 that has been printed in a second printing unit 03, and especially in the heatset machine lines 25, can be transferred to the first printing press 01, and can be fed, together with at least one web 11 that has been printed in a first printing unit 02, over a fold former 09 of the former assembly 07.

Because the machine line 25 and/or its machine alignment M2 is oriented transversely to the printing press 01 and/or its machine alignment M1, a web 21 coming from the machine line 25, as in the above-mentioned preferred embodiments, can, in a simple manner, be placed selectively over, between or under web sections of webs 11.1; 11.2; 11.3 that have been printed in the printing press 01, from the side, at a wide range of levels, in the superstructure 05. With the angled arrangement of the printing units 02; 03 or their machine alignments M1; M2 in relation to one another, the webs 21 that have been printed in the machine line 25 can be introduced, such as, for example, as heatset webs 21, in hybrid production at any level in the superstructure 05, and can thereby be inserted, without significant turning and combining operations, into the finished hybrid product.

To accomplish this, the first printing press 01, and especially in its superstructure 05, has at least one turning bar 32 at the level of the machine alignment M2 of the second machine line 25 and/or has one printing press 31, with which a web 21 or a partial web 21.1; 21.2, which is entering from the direction of the machine alignment M2, can be turned in a direction of transport along the machine alignment M1 and/or the direction of transport T1; T2'. The at least one turning bar 32 is essentially inclined 450 relative to the direction of transport T2 of the incoming web 21 and/or the machine alignment M2.

In the represented embodiment of FIG. 30, the turning bar 32 has a usable length, which, in projection to the incoming web 21, corresponds at least to its maximum width and/or to a maximum usable cylinder width of the imaging printing group cylinder 16. However, as has already been described to some extent above, for each full web 21 from the second printing press 31, a plurality of partial-width turning bars 32, such as, for example, a group of turning bars 32, which are arranged one above another, for use in turning a plurality of partial webs 21.1; 21.2, can also be provided.

If the machine lines 25 can be optionally operated in heatset operation or in coldset operation, then in one production situation, such as, for example, during newspaper production involving a large number of pages, one or more of the machine lines 25, such as the one, for example, equipped with printing formes having newspaper print pages, can be operated in coldset mode, and can insert "normal" sections of newspaper pages printed in coldset into the newspaper product produced on the coldset folder 08.

In another production situation, in which a hybrid product, which is comprised of newspaper pages and of at least one high-quality printed page, is to be produced, one or more of the machine lines 25 can be operated in heatset mode, and the heatsetprinted partial webs 21.1; 21.2 can be combined with the partial webs 11.1; 11.2; 11.3 printed on the newspaper printing press 01, via the turning device 10.

For all of the preceding preferred embodiments of the printing press system in accordance with the present invention, a further improvement provides for at least one of the printing units 02; 03 and/or a former assembly 07; 17 of the first or second printing press 01; 31 to be configured to produce so-called "pop-up" products, as is also depicted in FIG. 13 through 20).

Figure 31:
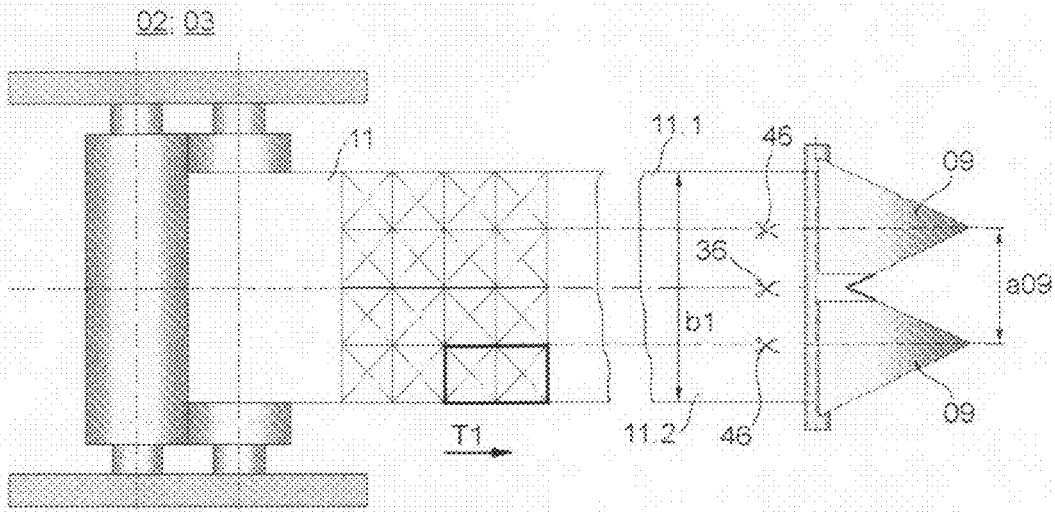
FIG. 31 *a*), *b*) and *c*) schematic representations of arrangements for guiding webs to fold formers to produce a "pop-up product"
Figure 31:
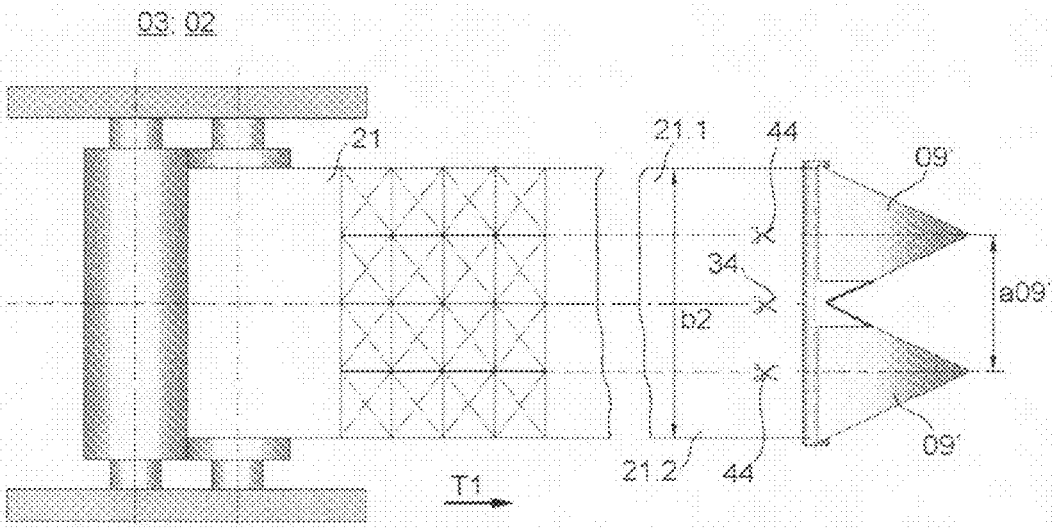
Figure 31:
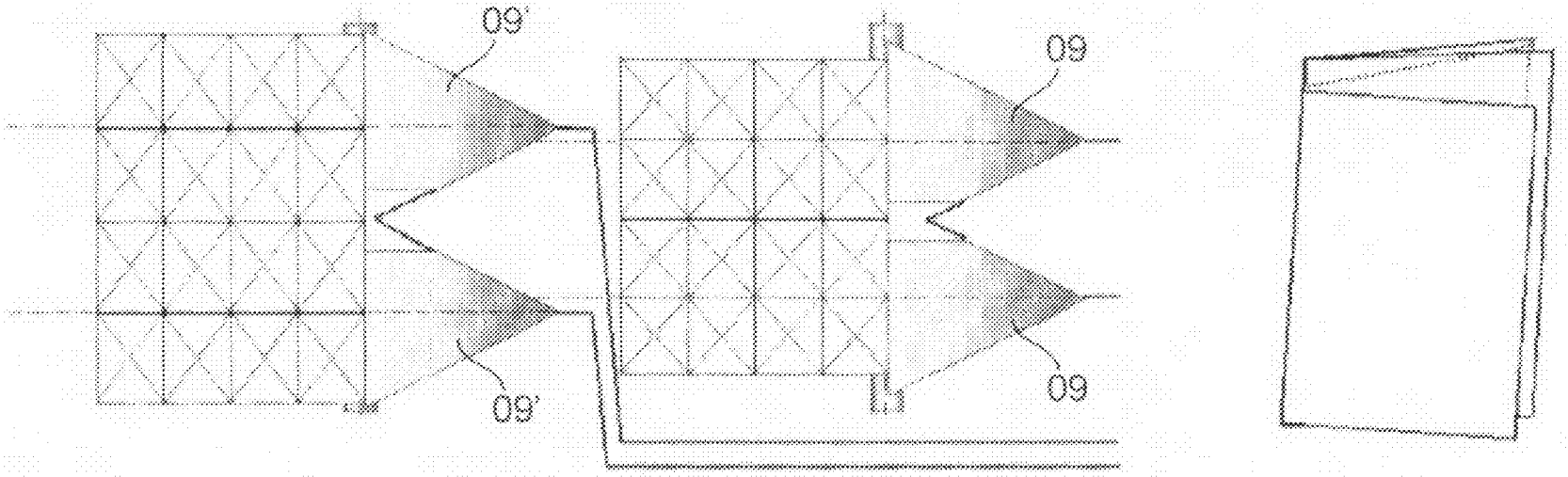
Figure 32:
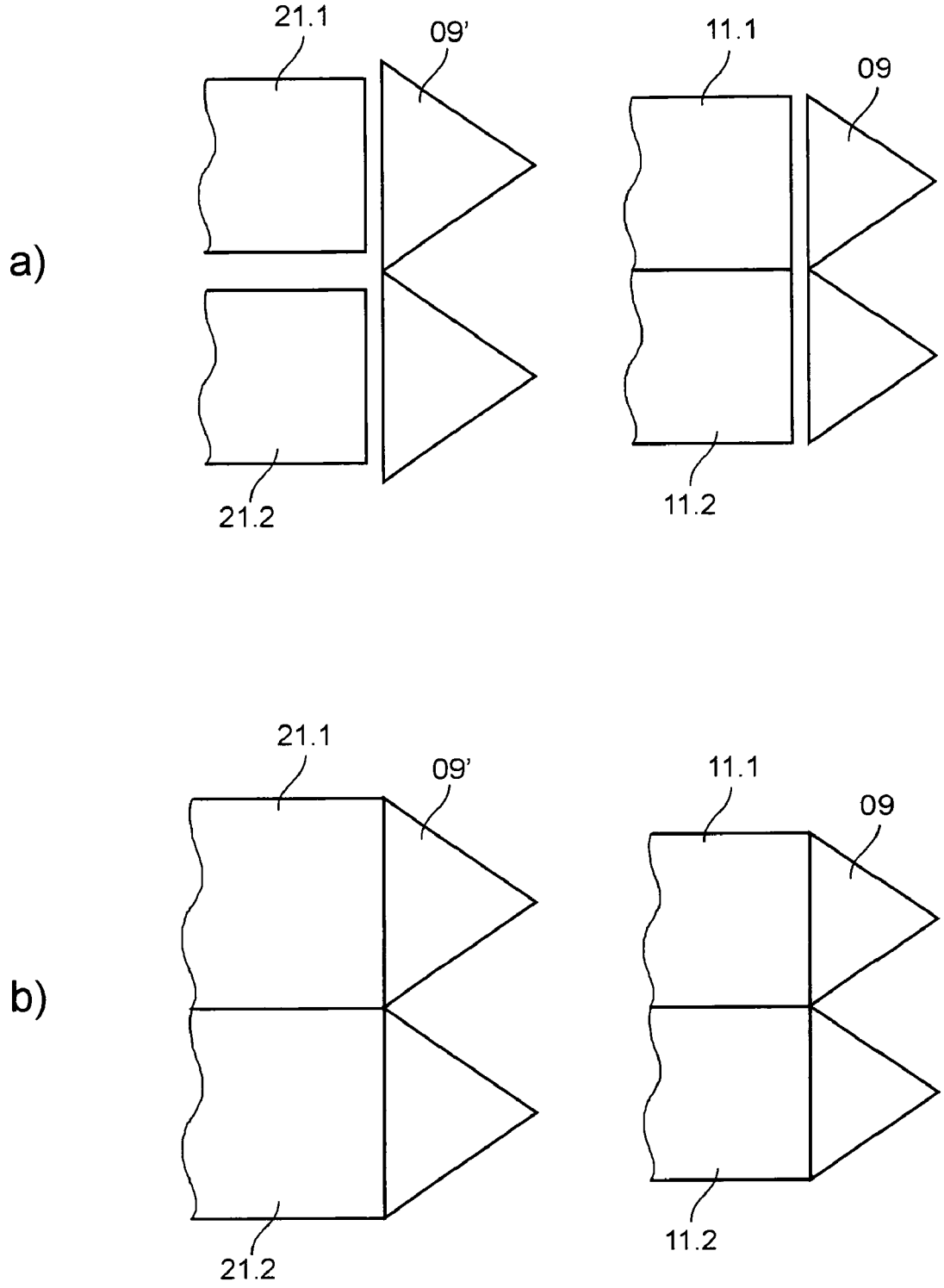
FIG. 32*a*) and *b*) schematic representations of arrangements for guiding webs to fold formers to produce a "pop-up product".

To accomplish this result, in a first configuration, a former assembly 07 for the first printing press 01 can be equipped with two groups of fold formers 09; 09', the effective widths of which differ, and which are therefore configured for use in folding partial webs 11.1; 11.2; 11.3 of different widths. In a further improvement, fold formers 09; 09' of at least one of the two former groups can be configured to be movable transversely to the web run-up direction, and thus transversely to the direction of web transport T1, and optionally to be adjustable in terms of their effective width via the provision of removable and/or fold-away insertion pieces. Depending upon each partial web width, the two adjacent fold formers 09; 09' are then brought into a position relative to one another such that a distance a09; a09' between the former peaks, as depicted in FIG. 31, can be different, and can be adjusted differently to the partial web width, in accordance with FIG. 24 *a*) through *c*). FIG. 24 schematically illustrates the situation within the context of two printing units 02; 03, through which webs 11; 21 of different web widths b1; b2 pass. The partial webs 11.1; 11.2; 21.1; 21.2 of the narrower web, either 11 or 21, are fed to the former group having the smaller distance a09 between the former noses of the fold formers 09; 09'. The partial webs 21.1; 21.2; 11.1; 11.2 of the wider web 21; 11 are fed to the former group having the greater distance a09' between the former noses of the fold formers 09'; 09. In FIG. 24, this principle has been specified using webs 11; 21 printed in a tabloid printing process, with horizontal print pages in tabloid format. Between the respective printing unit 02; 03 and its associated former assembly 07; 17 or fold former 09; 09', and in addition to the longitudinal cutting device 34; 36 for the main cutting lines, additional longitudinal cutting devices 44; 46, which are identified as supplementary cut lines, are provided. These cut the partial webs 11.1; 11.2; 21.1; 21.2 lengthwise in the area of the fold line to be formed or already formed. The configuration, which is shown for tabloid formats, can be similarly transferred to broadsheet production. However, then generally no cut is made in the supplementary cut lines, and the print pages are configured as vertical print pages, which in the illustration of FIG. 24 *a*), indicated in "bold" for one print page, correspond to approximately two tabloid pages.

In another variation of the present invention, the fold formers 09; 09' with the larger, maximum necessary effective width, for example corresponding to the representation of FIG. 25, can be permanently installed. However, the web 21 or the partial webs 21.1; 21.2 that are turned in the above preferred embodiments supply the wider partial webs 21.1; 21.2 in the hybrid operating mode, forming pop-ups, and are turned correspondingly. The printing units 03 are then configured to have a greater width, corresponding to the multiple of the print page format of the first printing press 01, so that an extended section will remain for each printed page width. Depending on the partial web width of the web 21 or of the partial webs 21.1; 21.2, which are entering from the side and are to be turned into the flow of the first printing press 01, with the positioning of the turning bars 32, which are movable, advantageously transversely to the machine alignment M1 of the first printing press 01, the respective partial web 21.1; 21.2 is oriented toward the respective former peak. For "normal" hybrid production, the adjacent partial webs 21.1; 21.2 run spaced from one another, from a plan view, taken of FIG. 25*a*), due to the greater effective former width. In pop-up production of maximum extension, such as with, maximum width, the cut and turned partial webs 21.1; 21.2 can run directly side by side to the adjacent fold formers 09', as seen in FIG. 25 *b*), based upon the fold former 09; 09' to be loaded. Depending upon the positioning of the turning bars 32, the two partial webs 21.1; 21.2 can also be fed, one above another, to the same fold former 09'.

What has been stated in the individual preferred embodiments regarding the components of the individual units, such as printing units 02; 03, former assemblies 07; 17, turning device 10; 42 and/or folders 08; 18, and the like, is to be transferred, where appropriate and where possible, to the respective other preferred embodiments, and vice versa. The teaching regarding comparable configurations of the two printing presses 01; 31 and/or printing units 02; 03 are also to be applied to one another, as in order to avoid repetition, not all details have been repeated in reference to each example.

While preferred embodiments of a printing machine system, in accordance with the present invention, have been set forth fully and completely hereinabove, it will be apparent to one of skill in the art that various changes in, for example, the drives for the various press components, the structure of the roll changers, and the like could be made without departing from the true spirit and scope of the present invention, which is accordingly to be limited only by the appended claims.

What is claimed is:

1. A printing press system comprising:

a first printing press (01) having a first machinery alignment (M1) and including at least two first printing units (02), each of said at least two first printing units being embodied as a printing tower (02) with each said printing tower having several first printing groups arranged vertically on top of each other and each being adapted for multi-color printing, on both sides of a separate first web passing through each of said at least two first printing units, each of said at least two first printing units having first printing group cylinders, said at least a first printing units being spaced from each other along said first machine alignment;

a first former assembly in said first printing press and arranged in said first machinery alignment (M1) of said at least two first printing units (02);

a second printing press (31) having at least one second printing unit (03) and a second machine alignment (M2), said at least one second printing unit (03) having at least one second printing group with second printing group cylinders adapted to print on a second web;

a second former assembly in said second printing press and arranged in said second machinery alignment (M2) of said at least one second printing unit (03), said first former assembly and said second former assembly being different from each other in at least one of a number of fold formers arranged side by side in a machine plane of each of said first and second former assemblies and an effective width of at least one of a fold former and a plurality of fold formers in each of said first and second former assemblies;

an orientation of said first and second printing presses wherein said first and second printing group cylinders (04; 06; 14; 16) of the first and second printing unit (02; 03) are oriented essentially orthogonally to one another in terms of their axial direction, and, the first and second former assemblies (07; 17) are orthogonal to one another with regard to a direction of web transport (T1; T1, T2), projected into the horizontal plane, of a web (11; 21) running up to each of said first and second former assemblies, and wherein one of a web (21; 11) and a partial web that has been printed by a printing unit (31; 01) of the one of the first and second printing presses (31; 01) can selectively be one of fed to the former assembly (17; 07) that is arranged in the machine alignment (M2; M1) of said one of said first and second printing presses (31; 01), and can be turned 90° and fed to the former assembly (07; 17) that is arranged in the machine alignment (Ml; M2) of the other of said first and second two printing presses (01; 31).

2. The printing press system according to claim 1, characterized in that the second machine alignment (M2) of the second printing press (31), and which extends perpendicular to the axial direction of the printing group cylinders (14; 16) of the second printing unit (03), is orthogonal to the first machine alignment (M1) of the first printing press (01), which extends perpendicular to the axial direction of the printing group cylinders (04; 06) of the at least two first printing units (02).

3. The printing press system according to claim 1, characterized in that the at least two first printing units (02) and the former assembly (07) of the first printing press (01) are arranged as a linear machine (01) in a shared machine alignment (M1) that is perpendicular to the axial direction of the first printing group cylinders (04; 06).

4. The printing press system according to claim 1, characterized in that the at least one second printing unit (03) and the second former assembly (17) of the second printing press (31) are arranged as a linear machine in a shared machine alignment (M2) that is perpendicular to the axial direction of the second printing group cylinders (04; 06).

5. The printing press system according to claim 1, further including a first turning device in the first machine alignment (M1) of the first printing press (01), and by use of said first turning device (10), in one production situation, a second web (21) that has been printed by the second printing unit (03) can be fed to the first former assembly (07) of the first printing press (01).

6. The printing press system according to claim 5, characterized in that the first turning device (10) is located in the area of the point of intersection of the first and second machine alignments (Ml; M2).

7. The printing press system according to claim 5, characterized in that the first turning device (10) has at least one turning bar (32), which is configured to be movable along one of the first and second machine alignments (M1; M2).

8. The printing press system according to claim 5, characterized in that the first turning device (10) has at least one turning bar (32), having a usable length which, when projected onto an incoming web (11; 21), corresponds to at least a maximum usable cylinder width of the respective printing group cylinder (14).

9. The printing press system according to claim 1, further including a first turning device in the first machine alignment (M1) of the first printing press (01), and by use of said first turning device (10), one of a second web (21) and a partial web (21.1; 21.2) that has been printed by the second printing unit (03) can be fed to the former assembly (07) of the first printing press (01), and a first web (11) and a first partial web (11.1: 11_2) that has been printed by the first printing unit (02) can be fed to the second former assembly (17) of the second printing press (17).

10. The printing press system according to claim 1, characterized in that the first printing press (01) has a first turning device (10), and in which first turning device, a second web (21) entering from the second printing unit (03) can be turned into a direction of transport (T1; T2') of a first web (11) coming from the first printing unit (02).

11. The printing press system according to claim 10, characterized in that the first turning device (10) is additionally configured to turn a first web (11) coming from the first printing unit (02) into a direction of transport of a second web (21) coming from the second printing unit (03).

12. The printing press system according to claim 1, characterized in that the first printing press (01) has a first turning device (10), with which a second web (21) entering from the direction of the second machine alignment (M2) of the second printing press (31) can be turned into a direction of transport (T1; T2') one of along and parallel to the first machine alignment (M1).

13. The printing press system according to claim 1, characterized in that the printing units (02; 03), which are orthogonal to one another, and the first and second former assemblies (07; 17), which are assigned to the respective first and second machine alignments (M1; M2), are each arranged on different sides of the machine alignment (M2; M1) of the other printing press 01; 31.

14. The printing press system according to claim 1, characterized in that the first and second machinery alignments (M1; M2) of the first and second printing presses (01, 31) are arranged in an X-configuration in relation to one another such that the first and second webs (11; 21), that have been printed in the two intersecting machine lines (25; 30), intersect at a right angle, on their respective paths, between the respective printing unit 02; 03 and the respective former assembly (07; 17) assigned in straight-line travel, as viewed in a horizontal projection.

15. The printing press system according to claim 1, characterized in that in one of the first and second printing presses (01; 31) the at least one printing unit (02; 03) and the former assembly (07; 17) that is assigned to the machine alignment (M1; M2) of this one of the first and second printing presses is arranged on the same side of the machine alignment (M2) of the other one of the first and second printing presses (31), and in the other of the first and second printing presses (01) the at least one printing unit (03; 02) and the former assembly (17; 07), that is assigned to this one of the first and second machine alignments (M1; M2), is arranged on different sides of the machine alignment (M1) of the first-named printing press (31).

16. The printing press system according to claim 1, characterized in that the first former assembly (07) of the first printing press (01) has a first group of at least two first fold formers (09) arranged side by side in the machine plane of the first former assembly.

17. The printing press system according to claim 16, further including a second group of at least two second fold formers and wherein the two of such groups of first and second fold formers (09), in said first former assembly are arranged one above another.

18. The printing press system according to claim 17, characterized in that the first and second groups of fold formers in said first former assembly differ in at least one of a number and an effective width of the fold formers (09) in each group, which are arranged side by side.

19. The printing press system according to claim 1, characterized in that the second former assembly (17) of the second printing press (31) has at least one of a third fold former (19) in one machine plane and a group of at least two third fold formers (19) arranged side by side in the same machine plane.

20. The printing press according to claim 1, characterized in that the at least two first printing units (02; 03) of the first printing press (01) and the at least one second printing unit (03; 02) of the second printing press (31) are configured as printing units (02; 03) of different types.

21. The printing press according to claim 20, characterized in that the two printing units (02; 03) of different types differ in terms of the printing process that is used by each.

22. The printing press according to claim 20, characterized in that the two printing units (02; 03) of different types differ in at least one of the maximum length that can be used for printing and in terms of the circumference of each printing group cylinder (04; 14).

23. The printing press according to claim 22, characterized in that the printing units (02; 03) of different types are configured differently such that a different number of print pages of the same format can be printed longitudinally along the printing group cylinders (04; 14) of the different printing units (02; 03).

24. The printing press according to claim 22, characterized in that the printing units (02; 03) of different types are configured differently such that a different number of print pages of the same format can be printed circumferentially along the printing group cylinders (04; 14) of the different printing units (02; 03).

25. The printing press according to claim 22, characterized in that the printing unit (02; 03) of the one type has printing group cylinders (04; 06) that are the width of at least four print pages, and the printing unit (03; 02) of the other type has printing group cylinders (14; 16) that are the width of two print pages.

26. The printing press according to claim 22, characterized in that at least the imaging printing group cylinder (04) of the printing unit (02; 03) of the one type has a circumference that corresponds to the length of two printed pages, and at least the imaging printing group cylinder (04) of the printing unit (03; 02) of the other type has a circumference that corresponds to the length of one printed page.

27. The printing press according to claim 20, characterized in that one of the printing unit (02; 03) is configured to be n-width and the other is configured to be m-width, with $n \neq m$, wherein n- or m-width refers to the width for printing 2*n or 2*m print pages, longitudinally along the printing group cylinder (04; 14; 06; 16).

28. The printing press according to claim 27, characterized in that partial webs (11.1; 11.2) of a web (11) that has been printed in the n-width printing unit (02) are one of turned 90° into the alignment of an (n−1)-width printing unit (03) and are fed to an (n−1)-width former assembly (17).

29. The printing press according to claim 20, characterized in that each of the at least two first printing units (02) of the first type is configured as an offset priming unit and the at least one second printing unit (03) of the second printing unit is configured as a flexo printing unit.

30. The printing press according to claim 20, characterized in that the at least two first printing units (02) of the first type are configured as one of an offset and a flexo printing unit and the at least one second printing unit (03) of the second type is configured as a printing unit for a non-impact printing process.

31. The printing press according to claim 1, characterized in that at least one drying means (15), is located downstream, in a direction of web travel, from said at least one printing unit (03) of the second printing press (31).

32. The printing press according to claim 31, characterized in that a web (11) that has been printed by a printing unit (02) of the first printing press is fed, without interacting with any drying means, to one of the first and second former assemblies (07; 17), and a web (21) that has been printed by a printing unit (03) of the second printing press is fed to one of the first and second former assemblies (07; 17) after passing through the at least one drying means.

33. The printing press according to claim 1, characterized in that each of the at least two printing units (02) of the first printing press (01) is traversed by a web (11) of uncoated or lightly coated paper, having a coating weight of at most 10 $g/m^2$, especially newsprint paper, and the at least one printing unit (03) of the second printing press (31) is traversed by a web (21) of coated paper having a coating weight of more than 10 $g/m^2$, especially more than 20 $g/m^2$.

34. The printing press according to claim 1, characterized in that a web (11) that has been printed by one of the at least two first printing units (02) can be fed to the first former assembly (07), which is arranged in the first machine alignment (M1), and at the same time, a web (21) that has been printed by the at least one second printing unit (03) can be fed to the second former assembly (07), which is arranged in the second machine alignment (M2).

35. The printing press according to claim 1, characterized in that a web (21) that has been printed by the at least one second printing unit (03) can be one of fed to the second former assembly (17), which is arranged in the second machine alignment (M2), and as viewed in the horizontal plane, can be turned 90° and fed to the first former assembly (07), which is arranged in the first machine alignment (M1).

36. The printing press according to claim 1, characterized in that a web (21) that has been printed by the at least one second printing unit (03) is turned 90°, as viewed in the horizontal plane, and, together with a web (11) that has been printed by one of the at least first and second printing units (02), can be fed to the first former assembly (07), which is arranged in the first machine alignment (M1).

37. The printing press according to claim 1, characterized in that a first partial web (11.1; 11.2; 21.1; 21.2) coming from one of the first and second printing presses (01; 31), with print images of printed pages of a first format, and a second partial web (21.1; 21.2; 11.1; 11.2) coming from the other of the first and second printing presses (31; 01), with print images of printed pages of a second format, which is different from the first format, are fed to the same former assembly (07; 17).

38. The printing press according to claim 37, characterized in that the first and second partial webs (11.1; 11.2; 21.1; 21.2) have different widths.

39. The printing press according to claim 1, characterized in that an imaging printing group cylinder (04; 14) of at least one of the at least two first printing units (02) bears four print pages of a certain format, side by side in an axial direction, and an imaging printing group cylinder (14; 04) of the at least one second printing unit (02) bears two print pages of a certain format, side by side in an axial direction.

40. The printing press according to claim 1, characterized in that an imaging printing group cylinder (04; 14) of at least one of the at least two first printing units (02) bears six print pages of a certain format, side by side in an axial direction, and an imaging printing group cylinder (14; 04) of the at least one second printing unit (02) bears two print pages of a certain format, side by side in an axial direction.

41. The printing press according to claim 1, characterized in that an imaging printing group cylinder (04; 14) of at least one of the at least two first printing units (02) bears six print pages of a certain format, side by side in an axial direction, and an imaging printing group cylinder (14; 04) of the at least one second printing unit (02) bears four print pages of a certain format, side by side in an axial direction.

42. The printing press according to claim 1, characterized in that an imaging printing group cylinder (04; 14) of at least one of the at least two first printing units (02) supports four printing formes with print pages of a certain format, side by side in an axial direction, and an imaging printing group cylinder (14; 04) of the at least one second printing unit (02) supports two printing formes with print pages of a certain format, side by side in an axial direction.

43. The printing press according to claim 42, characterized in that the printing formes and/or the print pages relate to a newspaper format.

44. The printing press according to claim 42, characterized in that the printing formes and/or the print pages relate to a tabloid format.

45. The printing press according to claim 42, characterized in that the printing formes and/or the print pages relate to the same format.

46. The printing press according to claim 42, characterized in that the printing formes are configured as removable printing plates.

47. The printing press according to claim 1, characterized in that an imaging printing group cylinder (04; 14) of at least one of the at least two first printing units (02) supports six printing formes with print pages of a certain format, side by side in an axial direction, and an imaging printing group cylinder (14; 04) of the at least one second printing unit (02) supports two printing formes with print pages of a certain format, side by side in an axial direction.

48. The printing press according to claim 1, characterized in that an imaging printing group cylinder (04; 14) of at least one of the at least two first printing units (02) supports six printing formes with print pages of a certain format, side by side in an axial direction, and an imaging printing group cylinder (14; 04) of the at least one second printing unit (02) supports four printing formes with print pages of a certain format, side by side in an axial direction.

49. The printing press according to claim 48, characterized in that an imaging printing group cylinder (04; 14) of at least one of the two different printing units (02; 03) supports two printing formes with print page of a certain format in a circumferential direction, and an imaging printing group cylinder (14; 04) of the other one of the two different printing units (03; 02) supports only one printing forme with one print page of a certain format in a circumferential direction.

50. The printing press according to claim 1, characterized in that the first printing press (01) has a longitudinal cutting device and a turning device for partial width webs in addition to the turning device (10).

* * * * *

UNITED STATES PATENT AND TRADEMARK OFFICE

CERTIFICATE OF CORRECTION

PATENT NO. : 8,001,892 B2
APPLICATION NO. : 12/086342
DATED : August 23, 2011
INVENTOR(S) : Eckert et al.

It is certified that error appears in the above-identified patent and that said Letters Patent is hereby corrected as shown below:

Column 31, claim 1, line 28, after “least”, change “a” to --two--.

Column 34, claim 29, line 39, after “offset”, change “priming” to --printing--.

Signed and Sealed this
First Day of November, 2011

David J. Kappos

David J. Kappos
*Director of the United States Patent and Trademark Office*